US005279207A

United States Patent [19]

Takada et al.

[11] Patent Number: 5,279,207

[45] Date of Patent: Jan. 18, 1994

[54] RODLESS CYLINDER

[75] Inventors: Yoshiyuki Takada, Tokyo; Michikazu Miyamoto, Ibaraki, both of Japan

[73] Assignee: SMC Kabushiki Kaisha, Tokyo, Japan

[21] Appl. No.: 975,469

[22] Filed: Nov. 12, 1992

[30] Foreign Application Priority Data

| | | | |
|---|---|---|---|
| Nov. 11, 1991 | [JP] | Japan | 3-294649 |
| Dec. 6, 1991 | [JP] | Japan | 3-323375 |
| Dec. 20, 1991 | [JP] | Japan | 3-339112 |

[51] Int. Cl.[5] ..... F01B 25/26; F01B 29/00

[52] U.S. Cl. ..... 92/5 R; 92/88; 277/DIG. 7

[58] Field of Search ..... 92/88, 165 R, 5 R

[56] References Cited

U.S. PATENT DOCUMENTS

| | | | |
|---|---|---|---|
| 2,200,427 | 5/1940 | Merz | 92/88 |
| 3,454,242 | 7/1969 | Feder et al. | 92/88 |
| 3,820,446 | 6/1974 | Granbom et al. . | |
| 4,373,427 | 2/1983 | Garlapaty et al. . | |
| 4,555,980 | 12/1985 | Hoglund . | |
| 4,664,020 | 5/1987 | Kaiser | 277/DIG. 7 |
| 4,685,383 | 8/1987 | Rucher | 277/DIG. 7 |
| 4,856,415 | 8/1989 | Noda | 92/88 |

FOREIGN PATENT DOCUMENTS

| | | | |
|---|---|---|---|
| 0104364 | 4/1984 | European Pat. Off. . | |
| 0135041 | 3/1985 | European Pat. Off. . | |
| 0177850 | 4/1986 | European Pat. Off. . | |
| 0177880 | 4/1986 | European Pat. Off. . | |
| 234033 | 9/1987 | European Pat. Off. . | |
| 0476265 | 3/1992 | European Pat. Off. . | |
| 3124915 | 1/1983 | Fed. Rep. of Germany . | |
| 3802703 | 8/1988 | Fed. Rep. of Germany . | |
| 470088 | 8/1937 | United Kingdom | 92/88 |

*Primary Examiner*—Thomas E. Denion

*Attorney, Agent, or Firm*—Oblon, Spivak, McClelland, Maier & Neustadt

[57] ABSTRACT

A rodless cylinder includes a cylinder body, a piston, a sliding table, first and second sealing members, and pairs of first and second holding mechanisms. The cylinder body has a bore defined in a cylinder tube whose ends are closed and a slit which extends along the longitudinal direction thereof and enables the bore to communicate with the outside. The piston is reciprocatively moved within the bore. The sliding table is coupled to the piston by a connecting portion extending through the slit and moved according to the reciprocating motion of the piston. The first and second sealing members are brought into engagement with the piston and the sliding table to close the slit. The pairs of first and second holding mechanisms are located on both sides of the bore and mounted to the cylinder body and the sliding table. The pair of first holding mechanisms respectively has first support members and first movable members both used to guide the sliding table when the piston is reciprocated and to support a vertical load which acts on the sliding table. The pair of second holding mechanisms respectively has second support members and second movable members both capable of guiding the sliding table when the piston is reciprocated and supporting a horizontal load which acts on the sliding table, so as to prevent the inside diameter of the bore from varying.

22 Claims, 22 Drawing Sheets

RODLESS CYLINDER

BACKGROUND OF THE INVENTION

1. Field of the Invention

The present invention relates to a rodless cylinder, and more specifically to a rodless cylinder wherein a load applied to a sliding table which is disposed outside a cylinder and displaced in accordance with the reciprocating motion of a piston, can be dispersed and supported on the cylinder side, thereby making it possible to smoothly move the sliding table in accordance with the reciprocating motion of the piston and to facilitate a further reduction in a space occupied by the rodless cylinder.

2. Description of the Related Art

In recent years, rodless cylinders have been widely used as workpiece feeding devices in factories or the like.

A rodless cylinder normally comprises a cylinder body having a slit defined therein so as to extend along the longitudinal direction thereof, and a sliding table. A piston put into the cylinder body is provided integrally with the sliding table by a connecting member.

The rodless cylinder can have a reduced in stroke as compared with a cylinder with a rod coupled thereto. Thus, the area occupied by the rodless cylinder is small and the rodless cylinder is easy to handle. The rodless cylinder can also prevent dust from entering therein as compared with the rod-coupled cylinder referred to above. As a result, highly accurate positioning operation can be effected.

This type of rodless cylinder has been disclosed in U.S. Pat. No. 4,373,427 or DE-PS 3,124,915, for example. In particular, the rodless cylinder described in DE-PS 3,124,915 is constructed such that a guide groove is defined in a given portion located outside a cylinder tube and a guiding means mounted to each of legs each of which extends toward the given portion from the ends of the sliding table, is fitted in each guide groove. According to DE-PS 3,124,915, when a lateral force is applied, the guiding means is held against the guide groove so as to avoid an increase in width of a slit.

According to DE-PS 3,124,915, however, each leg should be disposed so as to extend toward a position far spaced from the outer side of the cylinder tube as seen from the sliding table and to hold the guiding means. Thus, when the guiding means is fitted in the guide groove upon application of the lateral force, one end face of the cylinder tube, which defines the slit, forcibly approaches the other end face of the cylinder tube, which defines a slit on the opposite side. As a result, the inside diameter of a bore defined in the cylinder tube is reduced as a whole, so that a piston is forcibly inactivated. That is, the piston stops moving when the lateral force is applied. In other words, a workpiece feeding operation is unexpectedly stopped, thereby causing a problem that a workpiece held in engagement with the sliding table cannot be smoothly fed.

SUMMARY OF THE INVENTION

It is the object of the present invention to provide a rodless cylinder wherein the inside diameter of a bore can be prevented from varying even when a horizontal force is exerted on a sliding table in particular, thereby making it possible to smoothly reciprocate the sliding table without inactivating a piston.

According to a first aspect of the present invention, there is provided a rodless cylinder comprising a cylinder body having a bore defined in a cylinder tube whose ends are closed and a slit which extends along the longitudinal direction thereof and enables the bore to communicate with the outside, a piston reciprocatively movable within the bore, a sliding table coupled to the piston by a connecting portion extending through the slit and moved in accordance with the reciprocating motion of the piston, first and second sealing members brought into engagement with the piston and the sliding table so as to close the slit, and first and second holding mechanisms respectively are provided as a pair, the first and second holding mechanisms being located on both sides of the bore and mounted to the cylinder body and the sliding table, the pair of first holding mechanisms respectively having first support members and first movable members used to guide the sliding table when the piston is reciprocated and to support a vertical load which acts on the sliding table, the pair of second holding mechanisms respectively having second support members and second movable members capable of guiding the sliding table when the piston is reciprocated and supporting a horizontal load acting on the sliding table so as to prevent the inside diameter of the bore from varying.

The first support members and/or the second support members employed in the rodless cylinder can be used as rail-shaped members which extend along the longitudinal direction of the cylinder body. The first movable members and/or the second movable members employed in the rodless cylinder can be used as rotatable bodies which roll along the rail-shaped members.

At least one pair of rail-shaped members of the pair of second holding mechanisms can be provided on both sides of the bore defined in the cylinder body. Further, at least one pair of rotatable bodies of the pair of second holding mechanisms can be provided so as to be held in engagement with the pair of rail-shaped members toward the outside of the bore when a load acts on the sliding table.

It is also possible to provide means capable of adjusting the position of at least any one of the rotatable bodies of the first holding mechanisms and/or the second holding mechanisms.

The above position adjustable means can comprise a rod for eccentrically supporting the one rotatable body, a screw thread formed onto the rod, and a nut maintained in engagement with the screw thread so as to fix the angular position of the rod against the sliding table.

The first movable members and/or the second movable members can be used as guide members which extend along the longitudinal direction of the cylinder body. Further, the first support members and/or the second support members can be used as synthetic resin members along which at least the guide members slide.

It is also possible to use the first movable members and/or the second movable members as guide members which extend along the longitudinal direction of the cylinder body. In addition, the first support members and/or the second support members can be used as wear resistant surface-treated layers formed on portions where at least the guide members slide.

According to a second aspect of the present invention, there is provided a rodless cylinder comprising a cylinder body having a bore defined in a cylinder tube whose ends are closed and a slit which extends along the longitudinal direction thereof and enables the bore to communicate with the outside, a piston which is reciprocatively movable within the bore, a sliding table coupled to the piston by a connecting portion extending through the slit and moved in accordance with the reciprocating motion of the piston, first and second sealing members brought into engagement with the piston and the sliding table so as to close the slit, and first and second holding mechanisms respectively provided in a pair, the first and second holding mechanisms being mounted to the cylinder body and the sliding table and capable of guiding the sliding table when the piston is reciprocated and supporting vertical and horizontal loads which act on the sliding table, thereby preventing the inside diameter of the bore from varying, the positions of at least rolling portions and/or sliding portions of the pair of first holding mechanisms being set so as to be spaced away from the slit toward the opposite side of the bore.

The pair of second holding mechanisms can comprise at least one pair of rail-shaped members provided on both sides of the bore defined in the cylinder body, and at least one pair of rotatable bodies provided so as to be held in engagement with the pair of rail-shaped members toward the outside of the bore when a load is exerted on the sliding table.

It is also possible to provide means capable of adjusting the position of at least any one of the rotatable bodies of the first holding mechanisms and/or the second holding mechanisms along the direction which intersects the direction of an axis of the one rotatable body.

The position adjustable means can be comprised of a protrusion used to support the one rotatable body and formed with a slit cut inwardly of the sliding table, and a bolt threadedly inserted into the protrusion so as to adjust the width of the slit to thereby adjust the position of the one rotatable body along the direction intersecting the direction of its axis.

Further, ends of the sliding table, which extend in the direction which intersects the direction of movement of the sliding table, can be provided so as protrude outwardly from ends of the cylinder body and to surround the ends of the cylinder body.

At least one position sensor can be mounted to a side surface of the cylinder body, and a driving member for activating the position sensor can be attached to one end of the sliding table in opposing relationship to the position sensor.

The first holding mechanisms and/or the second holding mechanisms can include sliding surfaces which extend along the longitudinal direction of the cylinder body and wear resistant portions with which the sliding surfaces are brought into sliding contact.

At least the sliding surfaces and the wear resistant portions of the second holding mechanisms can be respectively provided on both sides of the bore defined in the cylinder body, and disposed so as to be held in engagement with one another toward the outside of the bore when a load is exerted on the sliding table.

It is possible to provide means for a adjusting the positions of at least either the wear resistant portions brought into sliding contact with the sliding surfaces or the sliding surfaces.

Each of the position adjusting means can include a protrusion provided with either one of the sliding surfaces or one of the wear resistant portions and formed with a slit cut inwardly of the sliding table, and a bolt threadedly inserted into the protrusion so as to adjust the width of the slit to thereby adjust the position of either the one sliding surface or the one wear resistant portion.

Each of the position adjustable means can include a swinging member formed at its one end with either the one sliding surface or the one wear resistant portion, and a pressing screw thread brought into engagement with the other end of the swinging member so as to swing the swinging member to thereby adjust the position of either the one sliding surface or the wear resistant portion.

The swinging member can be mounted to the sliding table and include a sliding surface provided at one end thereof.

The first holding mechanisms and the second holding mechanisms can be respectively provided selectively with rolling portions disposed in opposing relationship to portions for supporting a load which acts on the sliding table, and sliding portions provided in opposing relationship to other portions.

The above and other objects, features and advantages of the present invention will become apparent from the following description and the appended claims, taken in conjunction with the accompanying drawings in which preferred embodiments of the present invention are shown by way of illustrative example.

DESCRIPTION OF THE PREFERRED EMBODIMENTS

Figure 1:
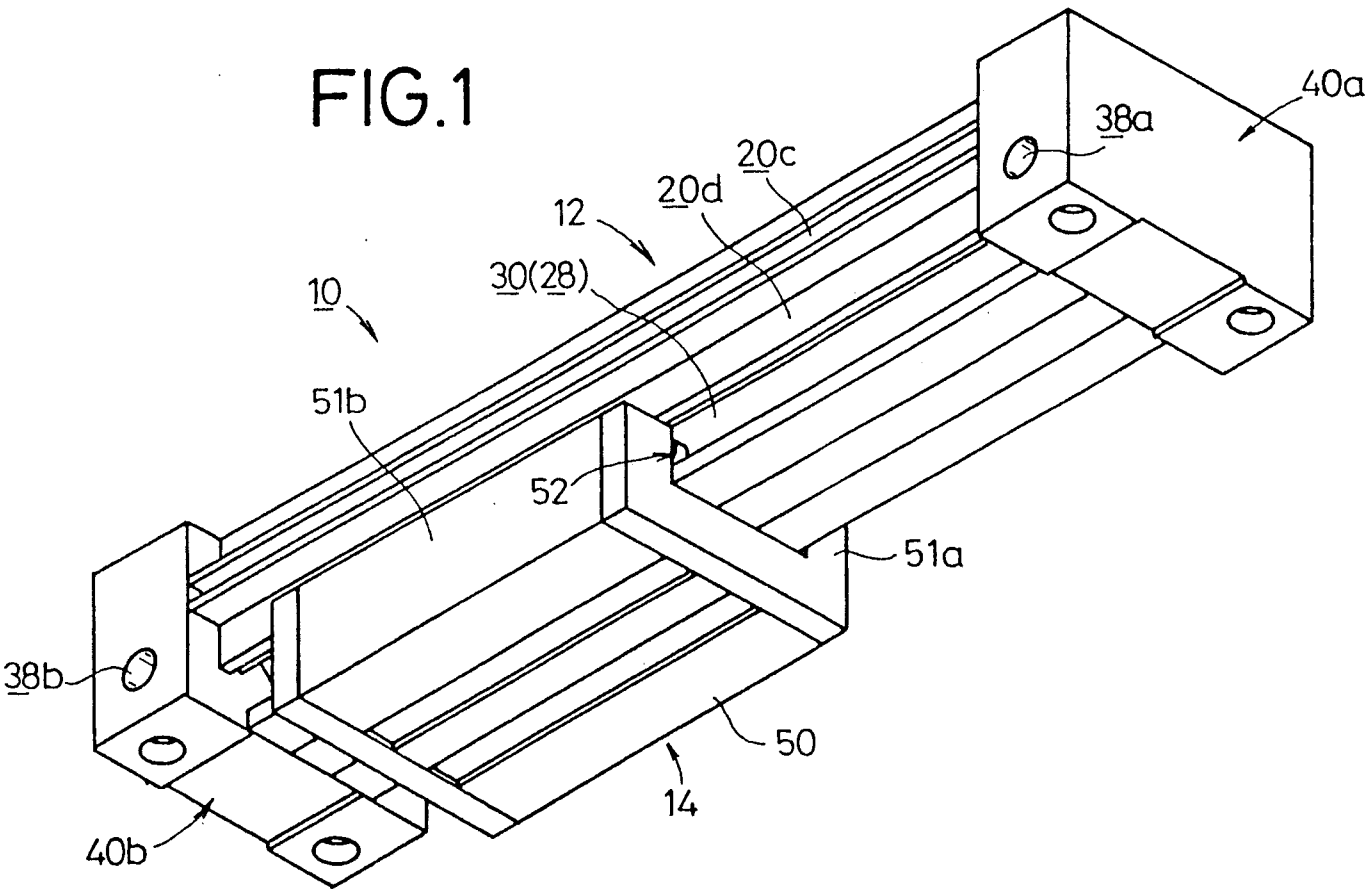
FIG. 1 is a perspective view showing a rodless cylinder according to a first embodiment of the present invention.
Figure 2:
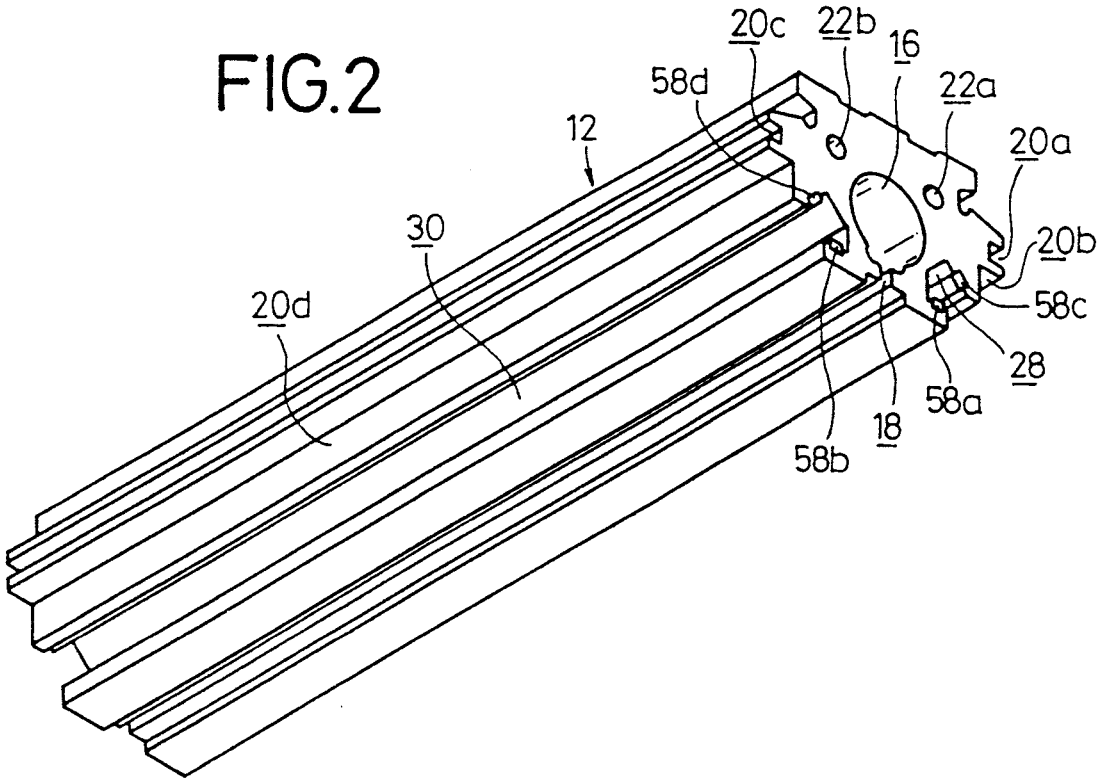
FIG. 2 is a perspective view showing a cylinder tube of the rodless cylinder shown in FIG. 1.
Figure 3:
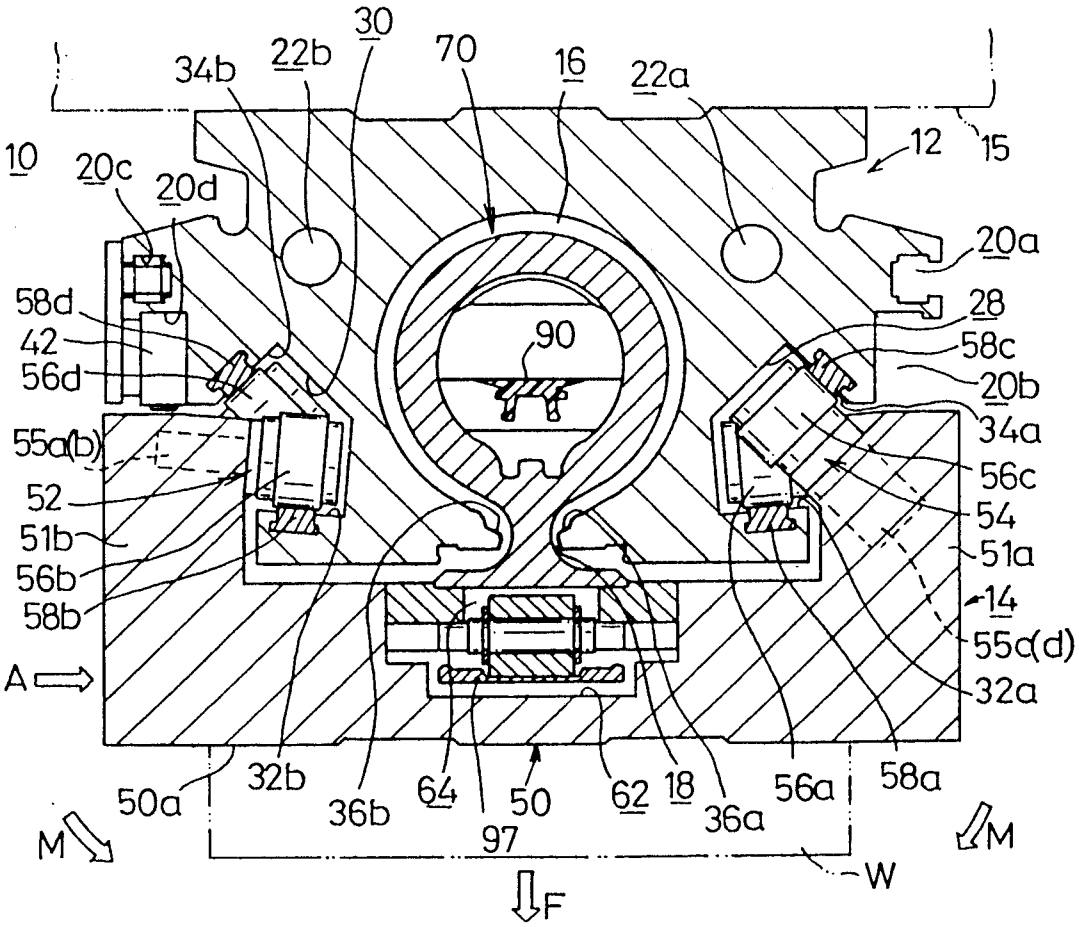
FIG. 3 is a vertical cross-sectional view illustrating a sliding table and the cylinder tube both employed in the rodless cylinder shown in FIG. 1.

In FIG. 1, reference numeral 10 indicates a rodless cylinder according to a first embodiment of the present invention. The rodless cylinder 10 comprises a cylinder body 12 and a sliding table 14. As shown in FIG. 3, the cylinder body 12 is suspended from a mounting wall surface 15 when in use. Further, the cylinder body 12 has a bore 16 which is defined therein and extends along the longitudinal direction thereof (see FIG. 2). The bore 16 is in communication with the outside through a slit 18 defined in one end surface of the cylinder body 12. As shown in FIG. 3, a plurality of sensor mounting elongated grooves 20*a* through 20*d* for fitting at least one sensor therein are defined in side walls of the cylinder body 12 so as to extend along the longitudinal direction thereof. Similarly, fluid bypass passages 22*a*, 22*b* used for centralized piping are also defined in the cylinder body 12 so as to extend along the longitudinal direction thereof.

Referring to FIG. 3, a first concave portion 28 and a second concave portion 30 are defined below the elongated grooves 20*b*, 20*d* by cutting the angular parts or corners of the cylinder body 12. First side surfaces 32*a*, 32*b* of the first and second concave portions 28, 30 are inclined slightly (several degrees) in opposite directions with respect to the horizontal direction. On the other hand, second side surfaces 34*a*, 34*b* of the first and second concave portions 28, 30 are inclined a predetermined degree, e.g., 45 degrees in opposite directions with respect to the vertical direction. The slit 18 causes the bore 16 to communicate with the outside. The opposite side walls of the slit 18 include steps 36*a*, 36*b* formed so as to be opened toward the bore 16.

Both ends of the cylinder body 12 constructed as described above are airtightly closed by end caps 40*a*, 40*b* with ports 38*a*, 38*b* defined therein, respectively (see FIG. 1). Incidentally, reference numeral 42 in FIG. 3 indicates a sensor for detecting the position of either a piston (to be described later) or the sliding table 14.

Figure 4:
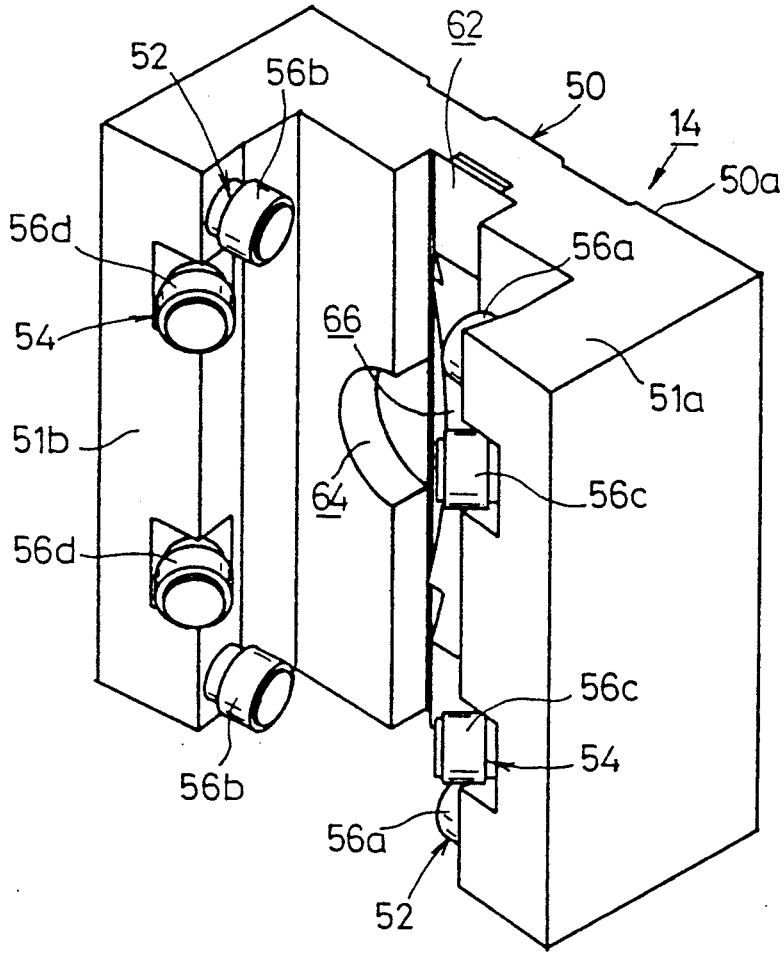
FIG. 4 is a perspective view showing the sliding table of the rodless cylinder shown in FIG. 1.

As shown in FIGS. 3 and 4, the sliding table 14 has a relatively thick and inverted U-shaped plate 50. A pair of first holding mechanisms 52 for guiding the sliding table 14 when the piston (to be described later) is reciprocated and for supporting a load applied to the sliding table 14 to thereby prevent of the inside diameter of the bore 16 from varying, is mounted on their corresponding arms 51*a*, 51*b* which protrude upward from transversely-extending ends of the plate 50 in FIG. 3, and fitted in their corresponding first and second concave portions 28, 30 of the cylinder body 12. On the other hand, a pair of second holding mechanisms 54 activated in the same manner as the pair of first holding mechanisms 52 is mounted on their corresponding arms 51*a*, 51*b* which protrude upward from the transversely-extending ends of the plate 50 in FIG. 3, and fitted in their corresponding first and second concave portions 28, 30 of the cylinder body 12. Each of the pair of first holding mechanisms 52 can actually support a load which vertically acts on the sliding table 14, whereas each of the pair of second holding mechanisms 54 can support a load which horizontally acts on the sliding table 14.

The pair of opposite first holding mechanisms 52 respectively includes rods 55*a*, 55*b* which are inclined slightly in opposite directions (i.e., downwardly with respect to the directions in which they approach each other as seen in FIG. 3) with respect to the horizontal direction and which are fixed to their corresponding opposite wall surfaces of the arms 51*a*, 51*b*, guide rollers (first movable members) 56*a*, 56*b* rotatably mounted to their corresponding leading ends of the rods 55*a*, 55*b*, and rail-shaped members (first support members) 58*a*, 58*b* fixed to their corresponding first side surfaces 32*a*, 32*b* of the cylinder body 12 so as to roll the guide rollers 56*a*, 56*b* therealong.

Similarly, the pair of opposite second holding mechanisms 54 respectively includes rods 55*c*, 55*d* which are inclined 45 degrees in directions opposite to each other (i.e., in directions in which they approach each other as seen in FIG. 3) with respect to the vertical direction and which are fixed to their corresponding opposite wall surfaces of the arms 51*a*, 51*b*, guide rollers (second movable members) 56*c*, 56*d* rotatably mounted to their corresponding leading ends of the rods 55*c*, 55*d*, and rail-shaped members (second support members) 58*c*, 58*d* fixed to their corresponding second side surfaces 34*a*, 34*b* of the cylinder body 12 so as to roll the guide rollers 56*c*, 56*d* therealong.

The sliding table 14 has a groove 62 which is defined in a central portion thereof and extends along the longitudinal direction thereof. The groove 62 includes an elliptically-enlarged space 64 defined in the center thereof. As is apparent from FIG. 4, the groove 62 has a concave portion 66 curved toward a lower surface 50*a* of the plate 50 of FIG. 3, which is provided on the side opposite the cylinder body 12 side.

Figure 5:
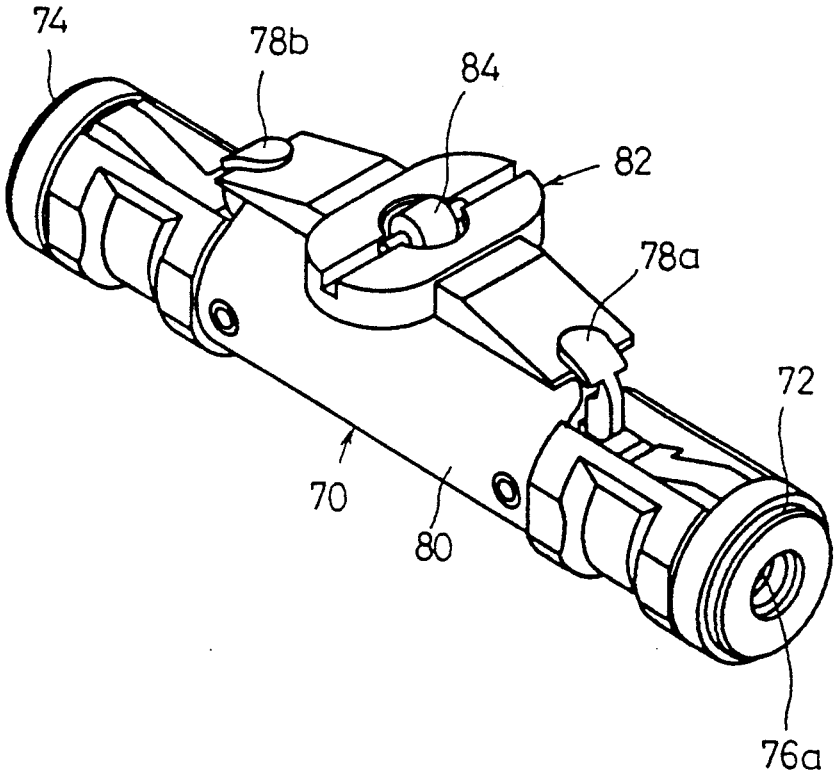
FIG. 5 is a perspective view showing a piston of the rodless cylinder shown in FIG. 1.
Figure 6:
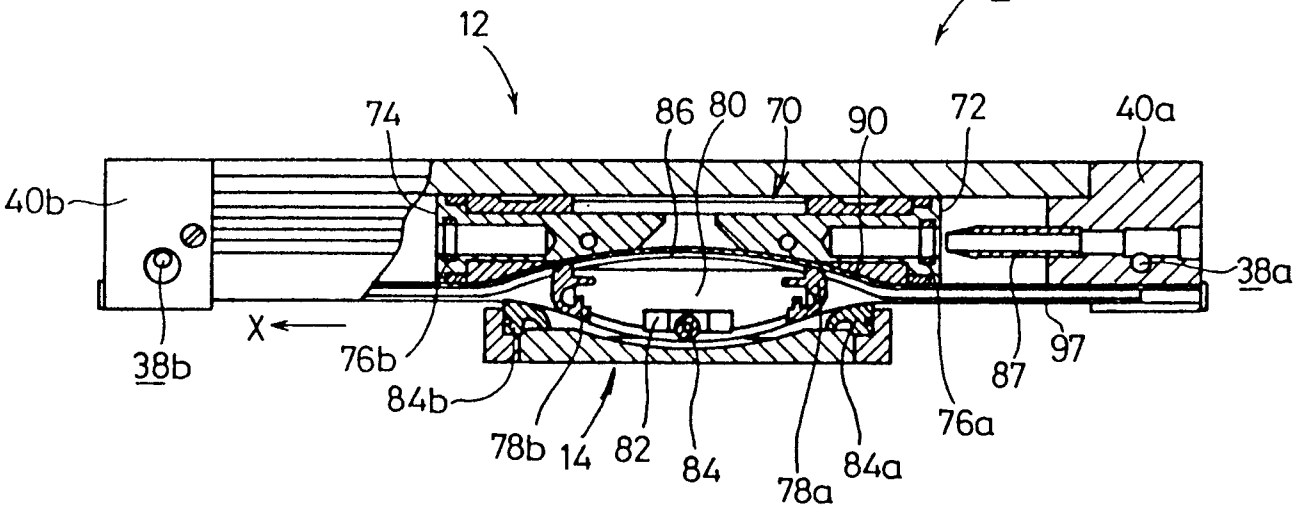
FIG. 6 is a side vertical cross-sectional view depicting the rodless cylinder shown in FIG. 1.

As shown in FIG. 5, the piston 70 has a first pressure-receiving surface 72 and a second pressure-receiving surface 74 provided on the side opposite the first pressure-receiving surface 64. Further, the piston 70 is provided therein with cushion seals 76*a*, 76*b* (see FIG. 6). The piston 70 includes belt separators 78*a*, 78*b* fixed to a piston yoke 80. A roller 84 is fixed to the piston yoke 80 by a coupler 82. The coupler 82 is shaped in the form of an ellipse so as to be fitted in the space 64 of the sliding table 14. Thus, the sliding table 14 can be moved integrally with the piston 70 in the direction indicated by the arrow X in a state in which the sliding table 14 has been coupled to the piston 70 by the coupler 82. Further, the sliding table 14 can be moved separately from the piston 70 in both the horizontal or lateral direction which intersects the direction indicated by the arrow X and the vertical direction. As shown in FIG. 6, scrapers 84*a*, 84*b* are provided inside the sliding table 14. The coupler 82 has opposite flat circular surfaces and is fitted in the circular space 64. Incidentally, reference numeral 86 in FIG. 6 indicates a passage for enabling a first sealing member to be described later to enter into the piston 70, and reference numeral 87 indicates a cushion ring.

Figure 7:
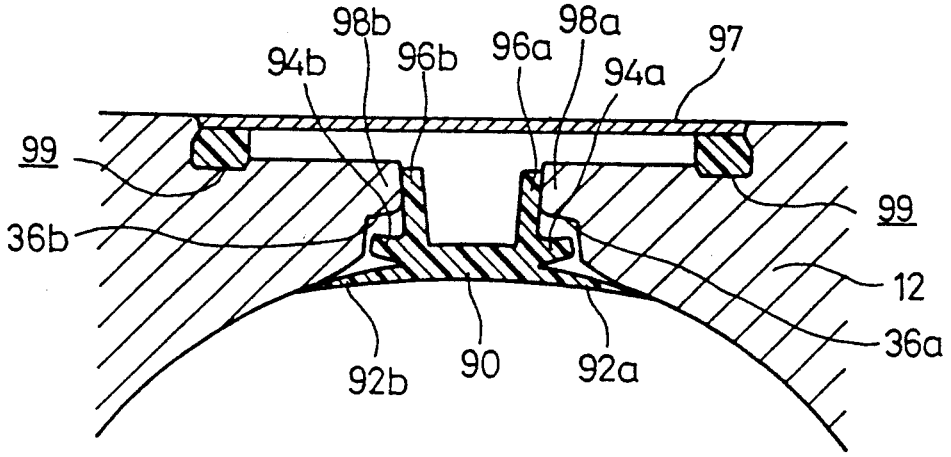
FIG. 7 is a partly cut vertical cross-sectional view illustrating the manner of fitting of a first sealing member employed in the rodless cylinder shown in FIG. 1 in a slit.

The first sealing member which is fitted on the steps 36*a*, 36*b*, will next be illustrated in FIG. 7. The first sealing member 90 has tongues 92*a*, 92*b* and extensions 94*a*, 94*b* disposed above the tongues 92*a*, 92*b* respectively. Further, the first sealing member 90 has engaging portions 96*a*, 96*b* which extend upwardly from the extensions 94*a*, 94*b* and are slightly opened in an upward direction. The extensions 94*a*, 94*b* are provided so as to be brought into engagement with the steps 36*a*, 36*b* when internal pressure is applied to the piston 70. Further, the engaging portions 96*a*, 96*b* are held against their corresponding internal surfaces 98*a*, 98*b* for defining the slit 18. The first sealing member 90 is integrally formed of a flexible synthetic resin as a whole. On the other hand, a second sealing member 97 is used to close the slit 18, and is fitted in opposite grooves 99 which are defined in the cylinder body 12 and extend along the longitudinal direction thereof. Incidentally, the first sealing member 90 enters into the passage 86 of the piston 70 and has both ends fixed to the end caps 40*a*, 40*b* together with the second sealing member 97.

The operation of the rodless cylinder 10 constructed as described above will now be described below.

After the cylinder body 12 has been suspended by the mounting wall surface 15 as shown in FIG. 3, a workpiece W is first fixed to the lower surface 50*a* of the sliding table 14. When compressed air is then introduced from the port 38*a*, it passes through a path or passage defined within the cushion ring 87 and is pressed against the first pressure-receiving surface 72. Thus, the piston 70 is displaced to the left (i.e., in the direction indicated by the arrow X) as seen in FIG. 6. Further, the coupler 82 is fitted in the space 64 of the sliding table 14. Therefore, the sliding table 14 is integrally displaced to the left. At this time, the belt separators 78*a*, 78*b* are activated to cause the first sealing member 90 and the second sealing member 97 to be spaced away from each other between the sliding table 14 and the piston 70. Thus, the workpiece W which has been placed on the sliding table 14, can be conveyed to the left as seen in FIG. 6. When the compressed air is introduced into the port 38*b*, an action opposite to the above action is effected.

Incidentally, the roller 84 is brought into sliding contact with the second sealing member 97 in the course of feeding of the workpiece to facilitate the feeding of the workpiece.

Referring now to FIG. 3, when a workpiece W which is relatively heavy in weight, is fixed onto the sliding table 14, a vertical load F acts on the sliding table 14. Further, a horizontal load is apt to act on the arms 51*a*, 51*b* by moments M. In the present embodiment, the guide rollers 56*a*, 56*b* and the rail-shaped members 58*a*, 58*b* of the pair of first holding mechanisms 52 can effectively receive the vertical load F. Further, the guide rollers 56*c*, 56*d* and the rail-shaped members 58*c*, 58*d*, which constitute the pair of second holding mechanisms 54 and are inclined with respect to the vertical direction, can reliably undergo or accept the load which is horizontally applied by the moments M. Here, the axial lines of the guide rollers 56*a*, 56*b* of the pair of first holding mechanisms 52 are inclined slightly downwardly with respect to the horizontal direction as seen in the direction in which they approach each other. Therefore, the piston 70 can be displaced against the moments M which act on the sliding table 14, without making the slit 18 wider, for example.

Further, the pair of second holding mechanisms 54 is particularly provided in the present embodiment. Therefore, even when an unexpected load is applied to the sliding table 14 along the horizontal or lateral direction, e.g., the direction indicated by the arrow A in FIG. 3, the load can be transmitted to and supported by the rail-shaped member 58*c* through the guide roller 56*c*, thereby making it possible to reliably bear the unexpected load. Thus, even when an abrupt load is applied to the sliding table 14, it is possible to avoid a situation in which the piston 70 is inactivated due to a reduction in the inside diameter of the bore 16 as described in the prior art.

Incidentally, the sensor 42 detects the positions of the piston 70 and the sliding table 14 by using a detecting member such as a magnet or the like, which is directly mounted to the arm 51*b* of the sliding table 14.

Figure 8:
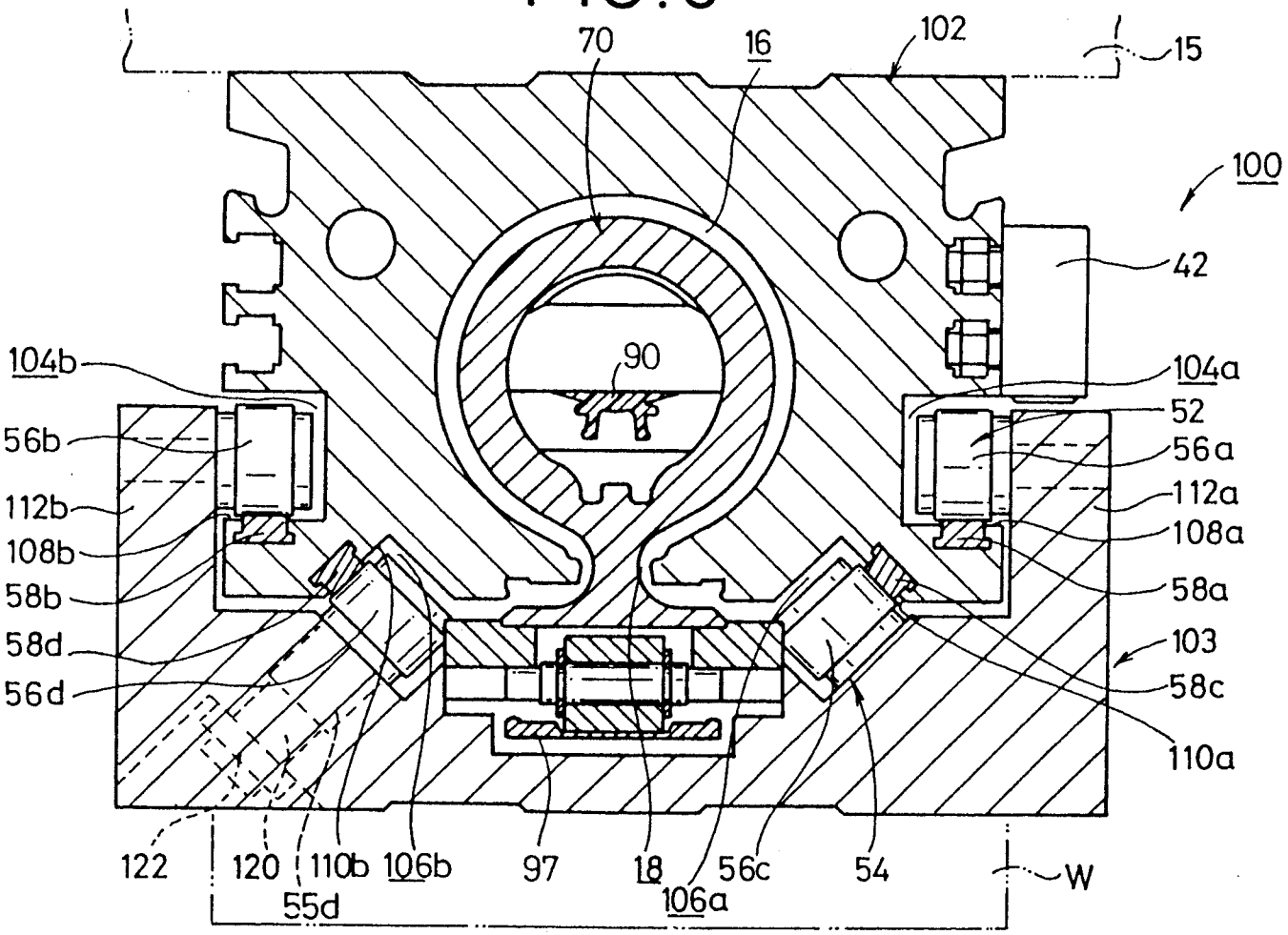
FIG. 8 is a vertical cross-sectional view showing a rodless cylinder according to a second embodiment of the present invention.

A rodless cylinder 100 according to a second embodiment of the present invention will next be described with reference to FIG. 8. Incidentally, reference numerals identical to those used in the rodless cylinder 10 according to the first embodiment indicate the same elements of structure as those employed in the rodless cylinder 10, and will not be described in detail.

The rodless cylinder 100 comprises a cylinder tube 102 and a sliding table 103. The cylinder tube 102 has first concave portions 104*a*, 104*b* defined in both sides thereof and second concave portions 106*a*, 106*b* defined in a lower surface thereof. Rail-shaped members 58*a*, 58*b* are fixedly mounted on first side surfaces 108*a*, 108*b* of the first concave portions 104*a*, 104*b* respectively, whereas rail-shaped members 58*c*, 58*d* are fixedly mounted on second side surfaces 110*a*, 110*b* of the second concave portions 106*a*, 106*b* respectively.

Guide rollers 56*a*, 56*b* of a pair of first holding mechanisms 52 are supported by their corresponding arms 112*a*, 112*b* of the sliding table 103 with the axial lines of the guide rollers 56*a*, 56*b* being oriented in the horizontal direction. Guide rollers 56*c*, 56*d* of a pair of second holding mechanisms 54 are supported on their corresponding corners of the sliding table 103 with each of the axial lines of the guide rollers 56*c*, 56*d* being inclined a predetermined angle from the vertical direction. The guide roller 56*d* is supported eccentrically by a rod 55*d* so as to be positionally adjustable in its radial direction. The rod 55*d* is provided with a thread 120 and a nut 122 engaged with the thread for fixing the angular position thereof against the sliding table. Incidentally, this positional adjustment is not necessarily limited to the guide roller 56*d*. The positional adjustment of other guide rollers 56*a* through 56*c* may be selectively effected.

In the rodless cylinder 100 constructed as described above, the workpiece W is fixedly mounted on the lower surface of the sliding table 103 after the cylinder tube 102 has been suspended by a mounting wall surface 15. Thus, the rodless cylinder 100 can reliably receive or bear loads by the pairs of first and second holding mechanisms 52, 54 in a manner similar to the rodless cylinder 10 even if the loads act on the sliding table 103 along the vertical and horizontal directions, thereby making it possible to smoothly effect the reciprocating motion of the piston 70.

Incidentally, the guide rollers 56*a*, 56*b* of the pair of first holding mechanisms 52 may be inclined in a manner similar to those employed in the rodless cylinder 10 according to the first embodiment.

Figure 9:
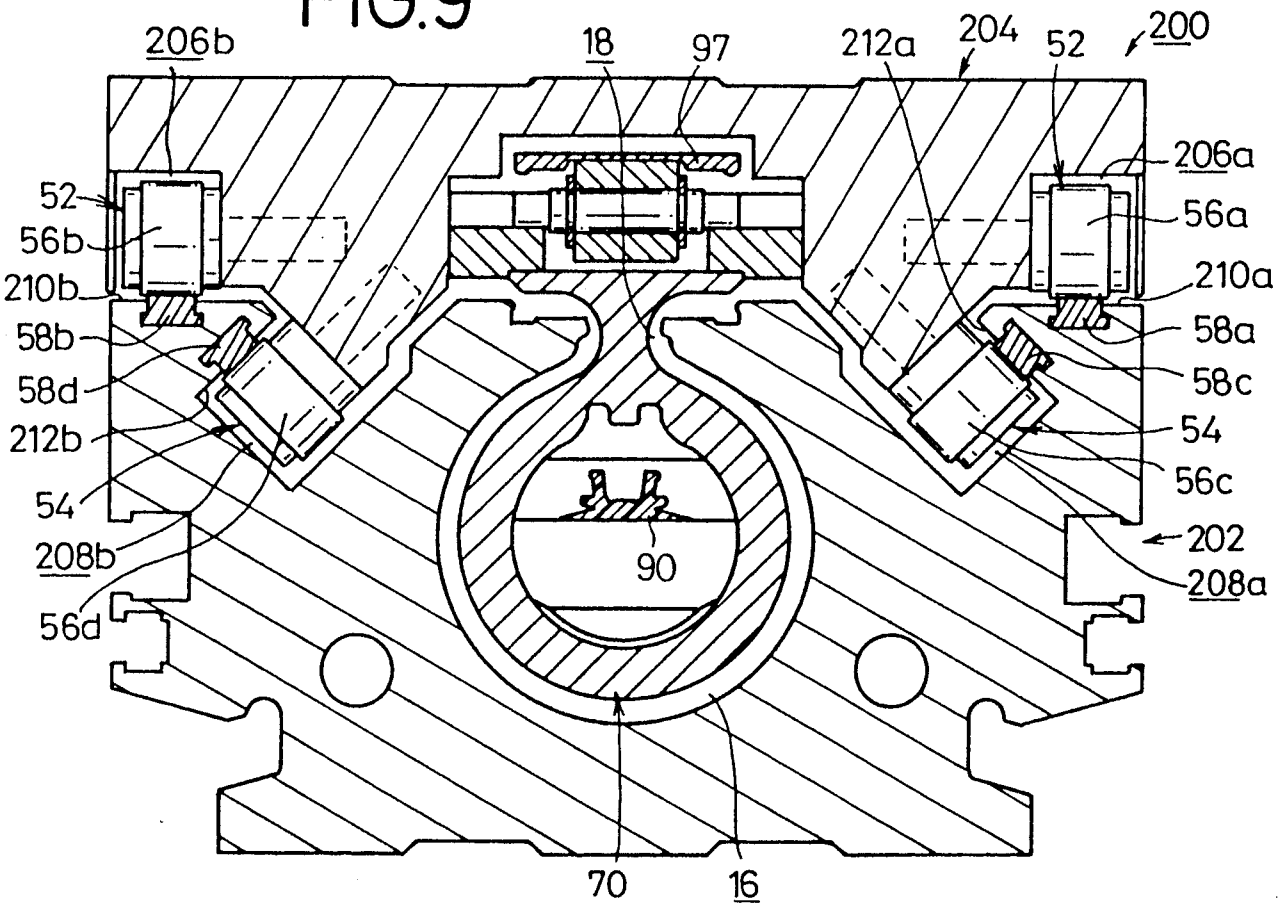
FIG. 9 is a vertical cross-sectional view depicting a rodless cylinder according to a third embodiment of the present invention.

Further, a rodless cylinder 200 according to a third embodiment of the present invention will be described below with reference to FIG. 9. Incidentally, reference numerals identical to those employed in the rodless cylinder 10 according to the first embodiment indicate the same elements of structure as those employed in the rodless cylinder 10, and will not be described in detail.

The rodless cylinder 200 is provided with a cylinder tube 202 and a sliding table 204. A sliding table 204 is movably placed on the cylinder tube 202 when in use. The sliding table 204 has first concave portions 206*a*, 206*b* defined in both sides thereof. The cylinder tube 202 has second concave portions 208*a*, 208*b* defined in the upper surface thereof. Rail-shaped members 58*a*, 58*b* are fixedly mounted on their corresponding upper end surfaces 210*a*, 210*b* of the cylinder tube 202, which correspond to the first concave portions 206*a*, 206*b* respectively. On the other hand, rail-shaped members 58*c*, 58*d* are fixedly mounted on side surfaces 212*a*, 212*b* of the second concave portions 208*a*, 208*b* respectively.

Guide rollers 56*a*, 56*b* of a pair of first holding mechanisms 52 and guide rollers 56*c*, 56*d* of a pair of second holding mechanisms 54 are supported on their corresponding corners of the sliding table 204. Each of the axial lines of the guide rollers 56*a*, 56*b* is inclined a given angle with respect to the horizontal direction as needed, whereas each of the axial lines of the guide rollers 56*c*, 56*d* is inclined a given angle (45 degrees, for example) with respect to the vertical direction.

Thus, the pairs of first and second holding mechanisms 52, 54 employed in the rodless cylinder 200 according to the third embodiment can reliably receive or bear loads which are exerted on the sliding table 204 along the vertical and horizontal directions. The rodless cylinder 200 can bring about the same advantageous effects as those obtained by the rodless cylinder 10.

Figure 10:
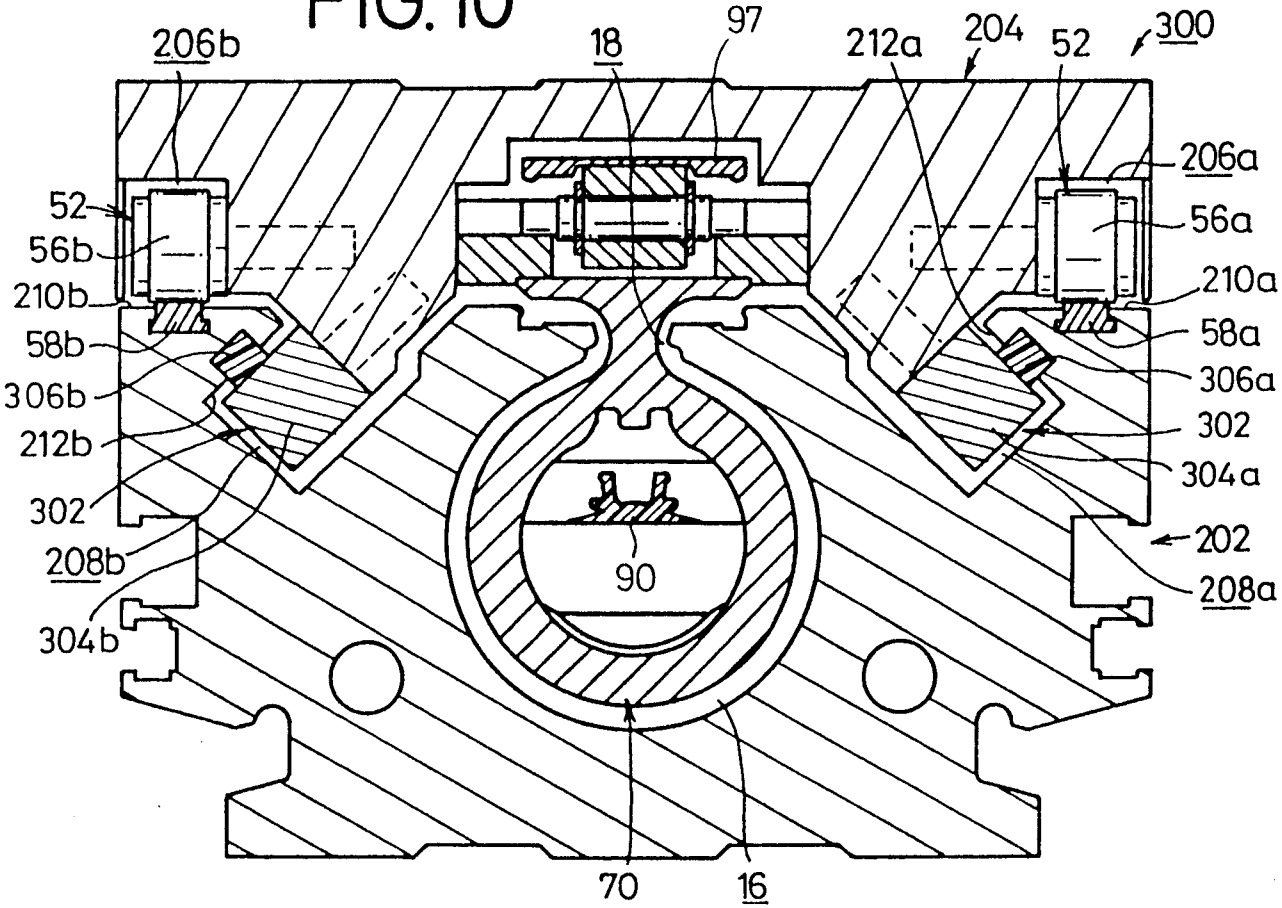
FIG. 10 is a vertical cross-sectional view illustrating a rodless cylinder according to a fourth embodiment of the present invention.

Furthermore, a rodless cylinder 300 according to a fourth embodiment of the present invention will be described below with reference to FIG. 10. Incidentally, reference numerals identical to those employed in the rodless cylinder 200 according to the third embodiment indicate the same elements of structure as those employed in the rodless cylinder 200, and their detailed description will therefore be omitted.

The rodless cylinder 300 according to the fourth embodiment has a pair of second holding mechanisms 302 different from the aforementioned pair of second holding mechanisms 54. The pair of second holding mechanisms 302 comprise a pair of guide members (second movable members) 304*a*, 304*b* which are fixed to a sliding table 204 and extend along its moving direction, and synthetic resin members (second support members) 306*a*, 306*b* which are fixed to side surfaces 212*a*, 212*b* of second concave portions 208*a*, 208*b*, respectively, of a cylinder tube 202 and which enable the pair of guide members 304*a*, 304*b* to be slid therealong. The synthetic resin members 306*a*, 306*b* are formed of materials having excellent sliding characteristics and high wear resistance.

In the rodless cylinder 300, the guide members 304*a*, 304*b* can therefore slide on the synthetic resin members 306*a*, 306*b* respectively so as to smoothly move the sliding table 204. The pair of second holding mechanisms 302 are comprised of the guide members 304*a*, 304*b* and the synthetic resin members 306*a*, 306*b* respectively. However, the pair of first holding mechanisms 52 can also be formed of these components respectively. As an alternative to the synthetic resin members 306*a*, 306*b*, surfaces formed by coating desired surfaces of the guide members 304*a*, 304*b* with wear resistant surface-treated layers such as synthetic resin films or hard alumite films may be used so as to be brought into sliding contact with the side surfaces 212*a*, 212*b*.

Figure 11:
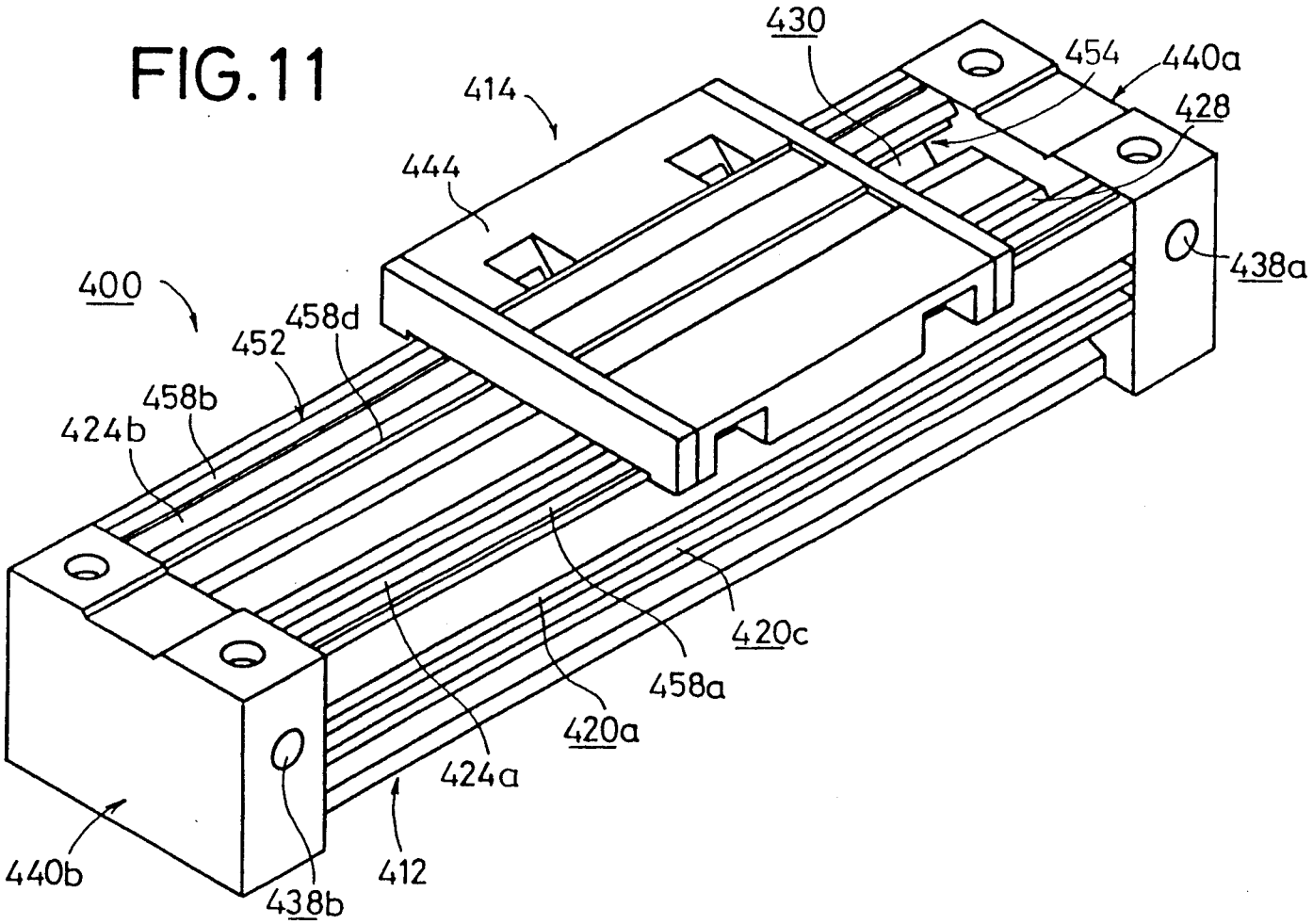
FIG. 11 is a perspective view showing a rodless cylinder according to a fifth embodiment of the present invention.
Figure 12:
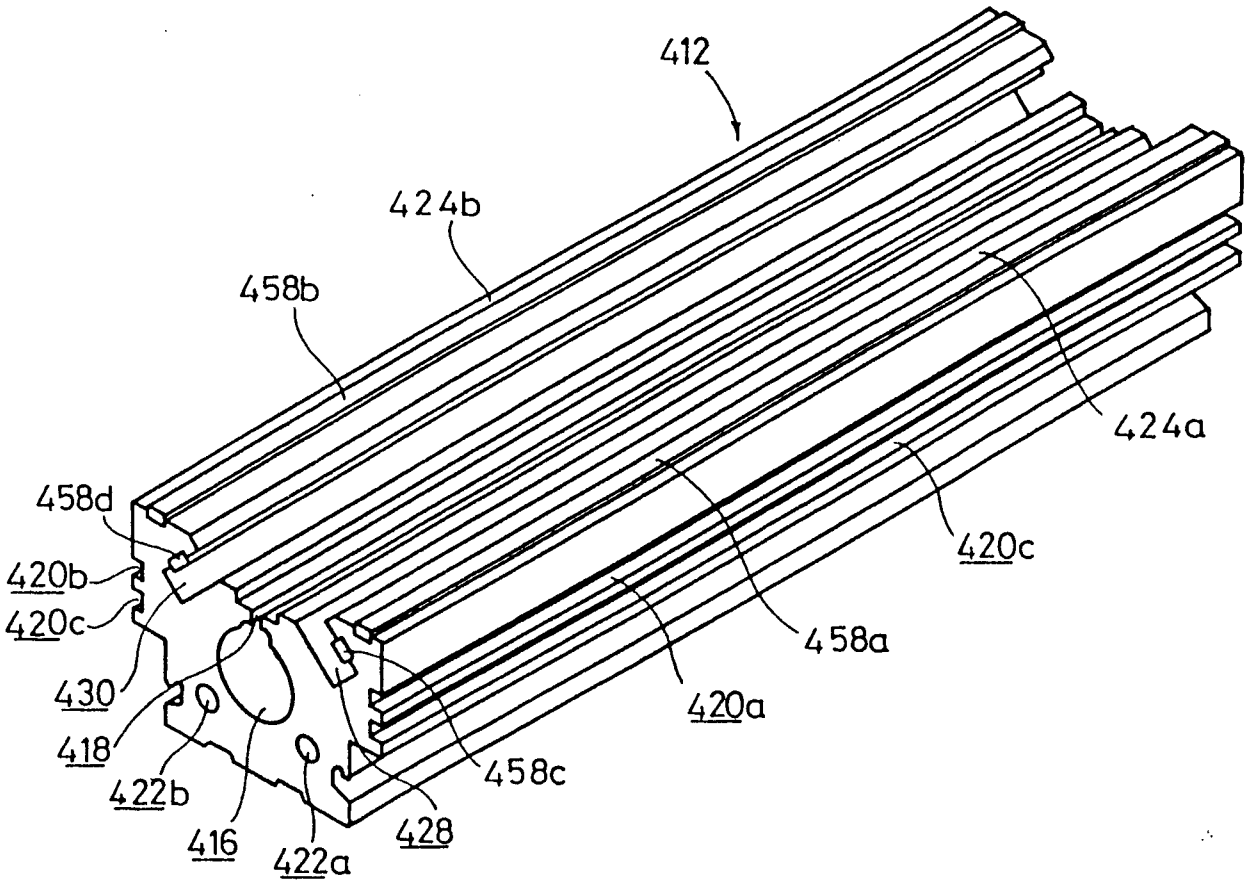
FIG. 12 is a perspective view illustrating a cylinder tube of the rodless cylinder shown in FIG. 11.
Figure 13:
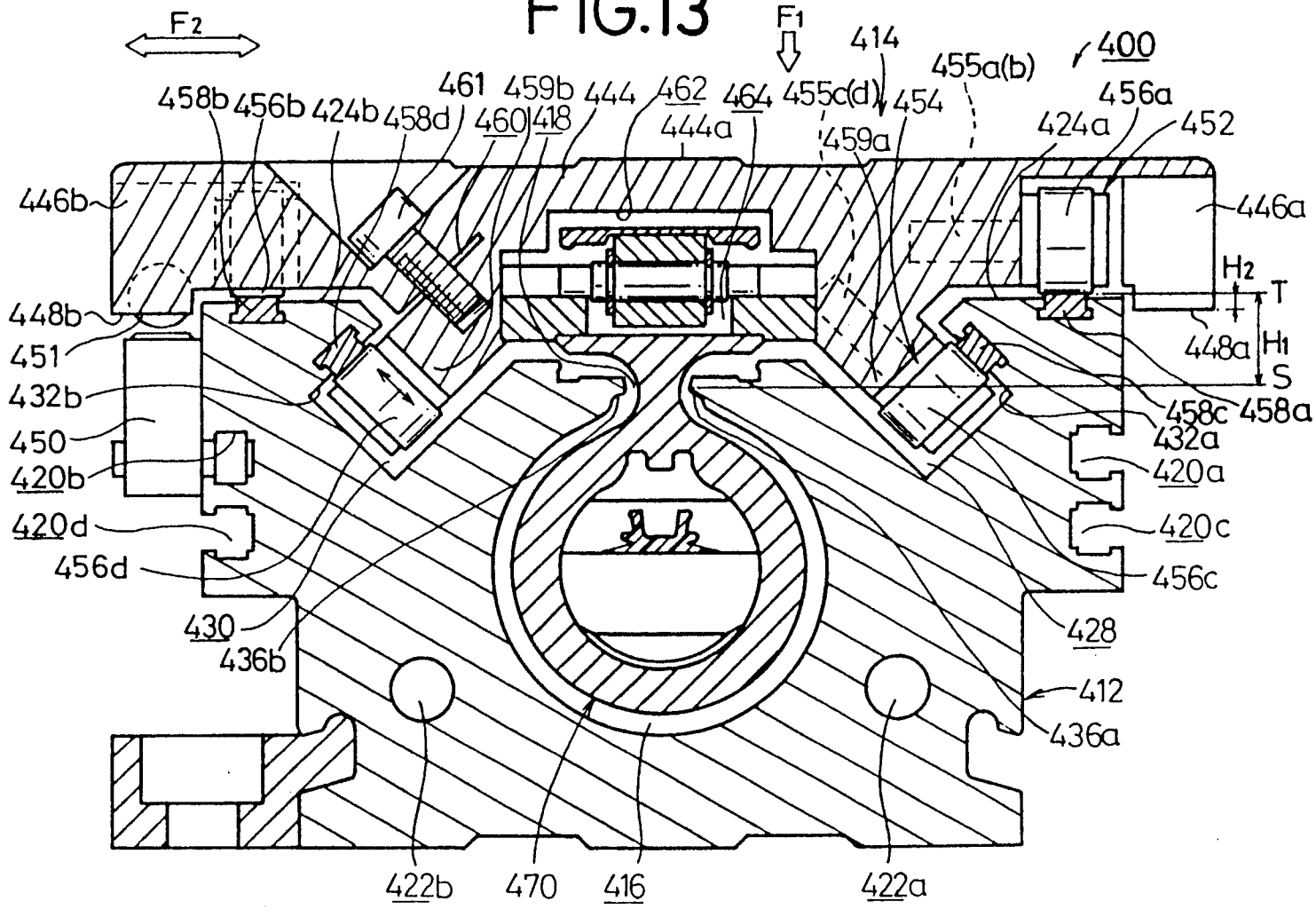
FIG. 13 is a vertical cross-sectional view showing a sliding table and the cylinder tube both employed in the rodless cylinder shown in FIG. 11.

A description will now be provided of a rodless cylinder 400 according to a fifth embodiment of the present invention. As shown in FIG. 11, the rodless cylinder 400 comprises a cylinder tube 412 and a sliding table 414. The cylinder tube 412 has a bore 416 which is defined therein and extends along the longitudinal direction thereof (see FIG. 12). The bore 416 is in communication with the exterior of the tube through a slit 418 defined in an end surface thereof. As shown in FIG. 13, the cylinder tube 412 has longitudinally-extending and sensor-mounting elongated grooves 420*a*, 420*b*, and longitudinally-extending and lead-accommodating elongated grooves 420*c*, 420*d* all of which are defined in both sides thereof. Further, the cylinder tube 412 also has fluid-bypass passages 422*a*, 422*b* defined therein for centralized piping so as to extend along the longitudinal direction thereof in the same manner as described above.

In FIG. 13, horizontally-extending upper surfaces 424*a*, 424*b* are provided at upper portions of both ends of the cylinder tube 412. Further, a first concave portion 428 and a second concave portion 430 are formed by cutting far or inner ends of the upper surfaces 424*a*, 424*b*. Respective side surfaces 432*a*, 432*b* of the first and second concave portions 428, 430 are inclined 45 degrees, for example, in opposite directions with respect to the vertical direction. The slit 418 enables the bore 416 to communicate with the outside as described above. However, opposite side walls which define the slit 418, include steps 436*a*, 436*b* formed so as to be opened toward the bore 416.

Both ends of the cylinder tube 412 constructed as described above are airtightly closed by end caps 440*a*, 440*b* with ports 438*a*, 438*b* defined therein, respectively (see FIG. 11).

Figure 14:
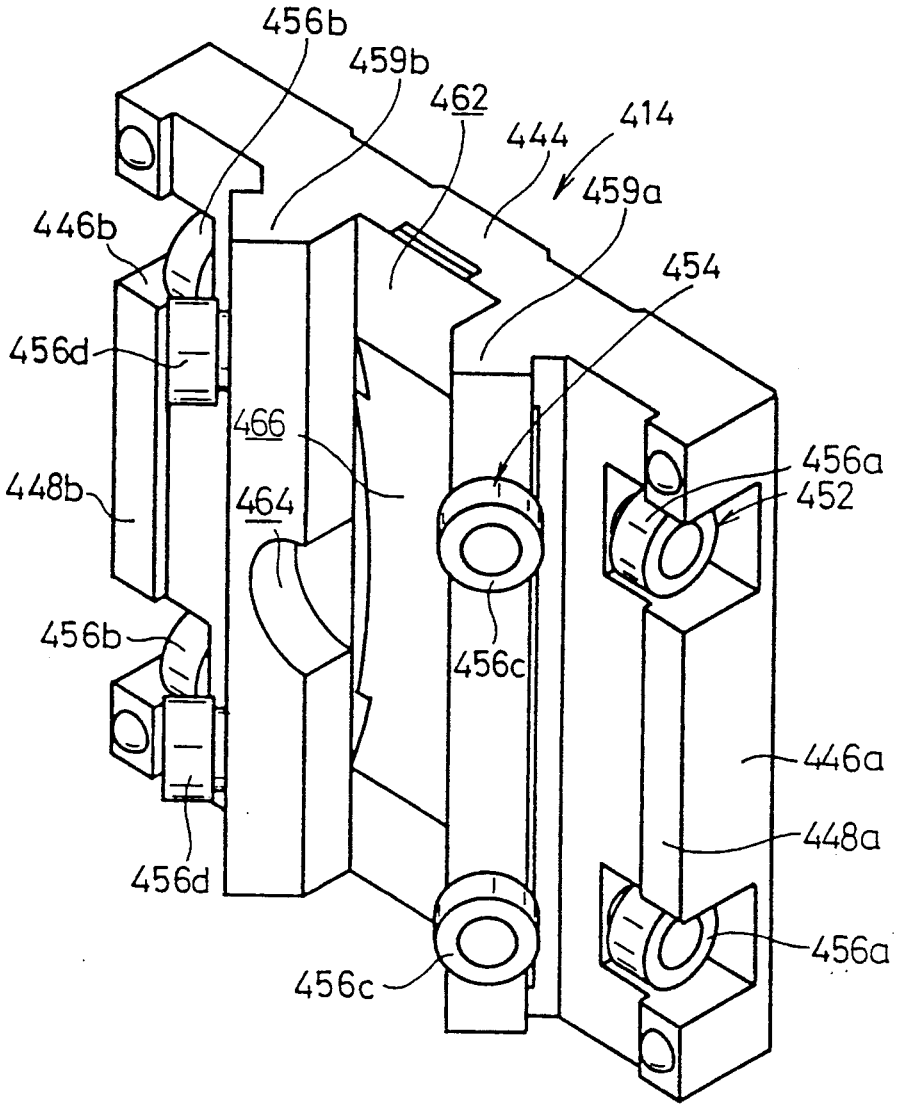
FIG. 14 is a perspective view depicting the sliding table of the rodless cylinder shown in FIG. 11.

As shown in FIGS. 13 and 14, the sliding table 414 includes a relatively-thick and inverted U-shaped plate 444. Transversely-extending ends 446*a*, 446*b* of the plate 444 protrude outwardly from the ends of the cylinder tube 412. Further, end surfaces 448*a*, 448*b* of the ends 446*a*, 446*b* are respectively provided downwardly from the upper surfaces 424*a*, 424*b* of the cylinder tube 412 so as to surround the ends of the cylinder tube 412. A magnetic sensor (position sensor) 450 for detecting the position of the sliding table 414 is mounted in the elongated groove 420*b* defined in the side surface of the cylinder tube 412. Further, a magnet or the like (driving member) 451 for activating the magnetic sensor 450 is mounted to the end 446*b* of the sliding table 414 in opposing relationship to the magnetic sensor 450.

In FIG. 13, a pair of first holding mechanisms 452 for guiding the sliding table 414 when a piston (to be described later) is reciprocated and for supporting a load applied to the sliding table 414 to thereby enable the prevention of the inside diameter of the bore 16 from varying, is fitted on the lower surface of the sliding table 414 and mounted on their corresponding upper surfaces 424*a*, 424*b*. On the other hand, a pair of second holding mechanisms 454 activated in the same manner as the pair of first holding mechanisms 452 is provided on the lower surface of the sliding table 414 and fitted in their corresponding first and second concave portions 428, 430. Each of the pair of first holding mechanisms 452 can actually support a load which vertically acts on the sliding table 414, whereas each of the pair of second holding mechanism 454 can support a load which horizontally acts on the sliding table 414.

The pair of first holding mechanisms 452 respectively includes rods 455*a*, 455*b* fixedly mounted on the lower surface side of the sliding table 414 so as to extend in the horizontal direction, guide rollers (rotatable bodies) 456*a*, 456*b* rotatably mounted on their corresponding leading ends of the rods 455*a*, 455*b* and rail-shaped members 458*a*, 458*b* fixed onto their corresponding upper surfaces 424*a*, 424*b* of the cylinder tube 412 so as to roll the guide rollers 456*a*, 456*b*. The position of each of rolling contact surfaces (rolling portions) T between the guide rollers 456*a* and the rail-shaped member 458*a* and between the guide rollers 456*b* and the rail-shaped member 458*b* is set so as to be spaced a distance H1 from the position S of the slit 418 toward the side (i.e., upwardly as seen in FIG. 13) opposite the bore 416 side. On the other hand, each of the end surfaces 448*a*, 448*b* of the sliding table 414 is protruded or lowered a distance H2 downward from each rolling contact surface T referred to above so as to prevent dust or the like from laterally entering each rolling contact surface T.

The pair of second holding mechanisms 454 respectively includes protrusions 459*a*, 459*b* formed on the lower surface of the sliding table 414 so as to be inclined 45 degrees in opposite directions (i.e., in directions in which they are spaced away from each other in FIG. 13) with respect to the vertical direction, rods 455*c*, 455*d* fixed to their corresponding protrusions 459*a*, 459*b*, guide rollers 456*c*, 456*d* rotatably mounted to their corresponding leading ends of the rods 455*c*, 455*d*, and rail-shaped members 458*c*, 458*d* fixed onto their corresponding side surfaces 432*a*, 432*b* of the cylinder tube 412 so as to roll the guide rollers 456*c*, 456*d*. The protrusion 459*b* is formed with a slit 460 cut inwardly of the sliding table 414. Each of the guide rollers 456*d* can be positionally adjusted in a direction which intersects each of the axial lines thereof, by inclining a bolt 461 from the upper surface of the sliding table 414 and causing the bolt 461 to threadedly engage its corresponding protrusion 459*b*.

The sliding table 414 has a groove 462 which is defined in a central portion thereof and extends along the longitudinal direction thereof. The groove 462 includes an elliptically-enlarged space 464 defined in the center thereof. As shown in FIG. 14, the groove 462 has a concave portion 466 curved toward a surface 444*a* of the plate 444 of FIG. 13, which is provided on the side opposite the cylinder tube 412 side.

Figure 15:
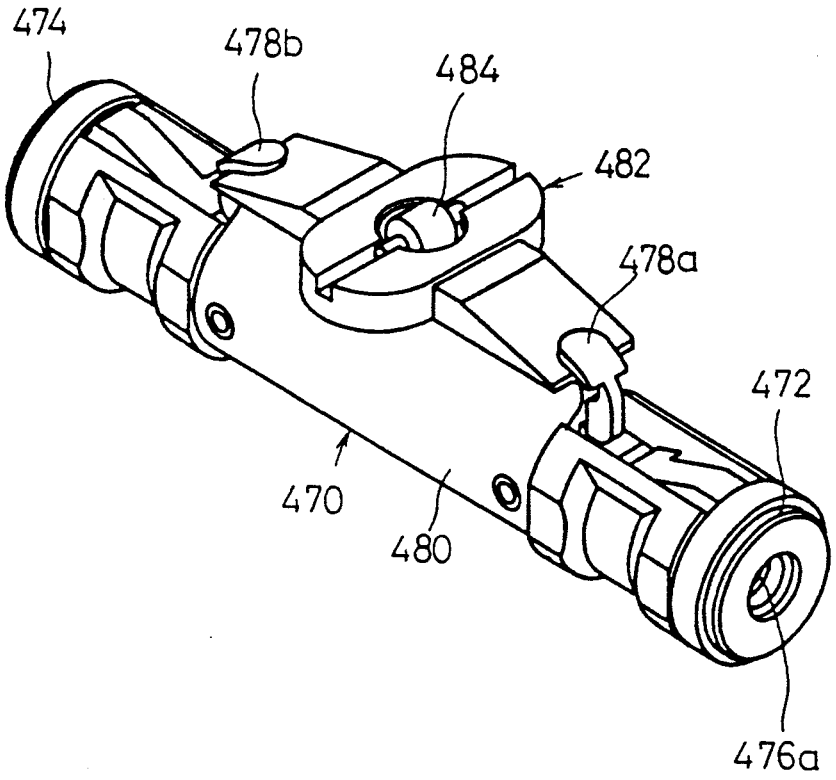
FIG. 15 is a perspective view showing a piston of the rodless cylinder shown in FIG. 11.
Figure 16:
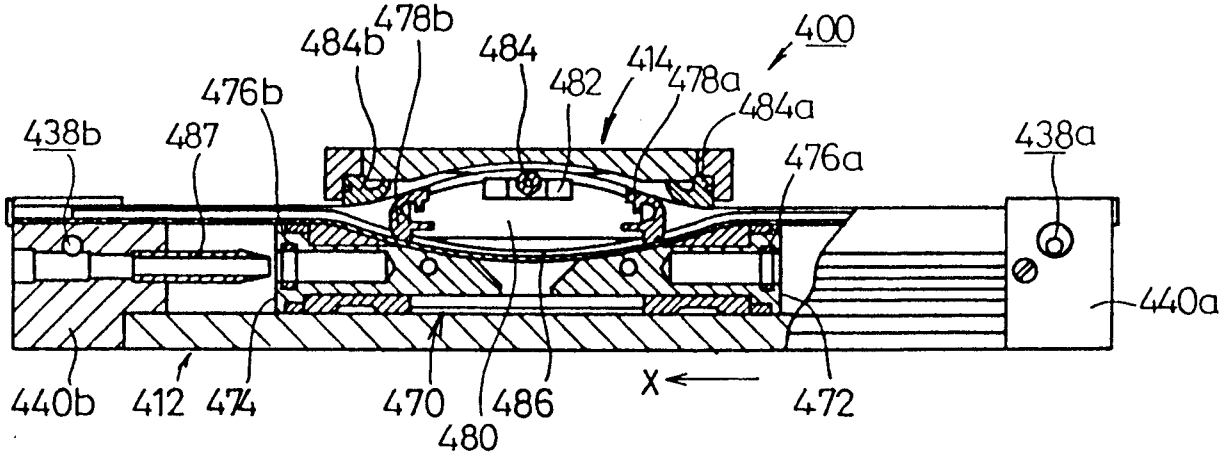
FIG. 16 is a side vertical cross-sectional view illustrating the rodless cylinder shown in FIG. 11.

As shown in FIG. 15, a piston 470 has a first pressure-receiving surface 472 and a second pressure-receiving surface 474 provided on the side opposite the first pressure-receiving surface 472. Further, the piston 470 is provided therein with cushion seals 476*a*, 476*b* (see FIG. 16). Belt separators 478*a*, 478*b* mounted on the piston 470 are fixed to a piston yoke 480. A roller 484 is fixed to a position above the piston yoke 480 by a coupler 482. As shown in FIG. 16, scrapers 484*a*, 484*b* are provided inside the sliding table 414. The coupler 482 has opposite flat circular surfaces and is shaped in the form of an ellipse so as to be fitted in the elliptical space 464. Incidentally, reference numeral 486 in FIG. 16 indicates a passage for enabling a first sealing member to be described later to enter into the piston 470, and reference numeral 487 indicates a cushion ring.

Figure 17:
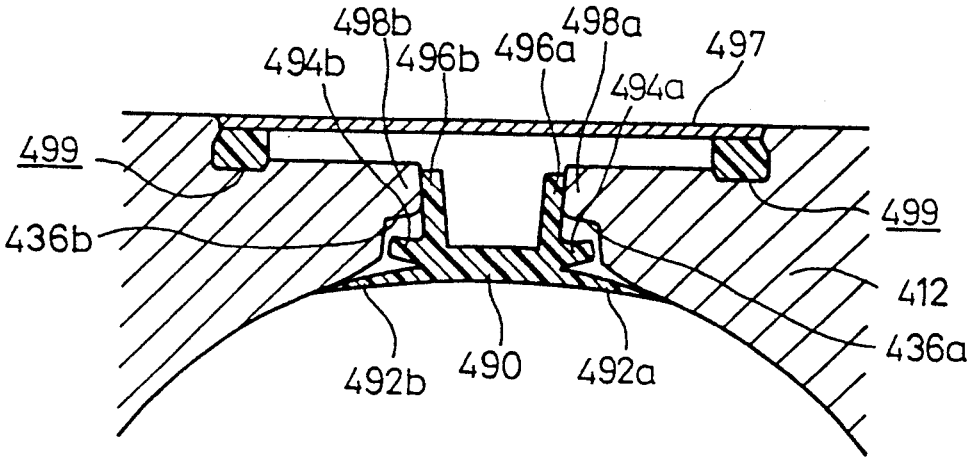
FIG. 17 is a partly cut vertical cross-sectional view showing the manner of fitting of a first sealing member employed in the rodless cylinder shown in FIG. 11 in a slit.

The first sealing member which is fitted on the steps 436*a*, 436*b*, will next be shown in FIG. 17. The first sealing member 490 has tongues 492*a*, 492*b* and extensions 494*a*, 494*b* disposed above the tongues 492*a*, 492*b* respectively. Further, the first sealing member 490 has engaging portions 496*a*, 496*b* which extend upwardly from the corresponding extensions 494*a*, 494*b* and are slightly opened in an upward direction. The extensions 494*a*, 494*b* are provided so as to be brought into engagement with the steps 436*a*, 436*b* when internal pressure is applied to the piston 470. Further, the engaging portions 496*a*, 496*b* are held against their corresponding internal surfaces 498*a*, 498*b* for defining the slit 418. The first sealing member 490 is integrally formed of a flexible synthetic resin as a whole. On the other hand, a second sealing member 497 is used to close the slit 418, and fitted in opposite grooves 499 which are defined in an upper end surface of the cylinder tube 412 and extend along the longitudinal direction of the cylinder tube 412. Incidentally, the first sealing member 490 enters into the passage 486 of the piston 470 and has both ends fixed to the end caps 440*a*, 440*b* together with the second sealing member 497.

The operation of the rodless cylinder 400 constructed as described above will now be described below.

After the cylinder tube 412 has been positioned as shown in FIG. 13, a workpiece (not shown) is first fixedly mounted on the surface 444*a* of the sliding table 414. When compressed air is then introduced from the port 438*a*, it passes through a path or passage defined within the cushion ring 487 and is pressed against the first pressure-receiving surface 472. Thus, the piston 470 is displaced to the left (i.e., in the direction indicated by the arrow X) as seen in FIG. 16. Further, the coupler 482 is fitted in the space 464 of the sliding table 414. Therefore, the sliding table 414 is integrally displaced to the left. At this time, the belt separators 478*a*, 478*b* are activated so as to cause the first sealing member 490 and the second sealing member 497 to be spaced away from each other between the sliding table 414 and the piston 470. Thus, the workpiece which has been placed on the sliding table 414, can be conveyed to the left as seen in FIG. 16. When the compressed air is introduced into the port 438*b*, the action opposite to the above action is effected.

Incidentally, the roller 484 is brought into sliding contact with the second sealing member 497 in the course of feeding of the workpiece to facilitate the feeding of the workpiece.

Referring now to FIG. 13, when a workpiece which is relatively heavy in weight, is fixedly placed on the sliding table 414, a vertical load F1 is applied to the sliding table 414. However, the vertical load F1 can be reliably received or borne by the guide rollers 456*a*, 456*b* and the rail-shaped members 458*a*, 458*b* of the pair of first holding mechanisms 452. Further, even when an unexpected load F2 is horizontally applied to the sliding table 414, the load F2 can be reliably received by the guide rollers 456*c*, 456*d* each inclined a given degree with respect to the vertical direction and the rail-shaped members 458*c*, 458*d* of the pair of second holding mechanisms 454.

At this time, the guide rollers 456*c*, 456*d* of the pair of second holding mechanisms 454 are brought into engagement with their corresponding rail-shaped members 458*c*, 458*d* so as to be directed or oriented toward the outside of the bore 416 when the load F2 acts on the sliding table 414. Thus, even when an abrupt load is applied to the sliding table 414, it is possible to avoid a situation in which the inside diameter of the bore 416 is reduced, thereby inactivating the piston 470 as in the prior art.

Further, the position of each of the rolling contact surfaces T between the guide rollers 456*a* and the rail-shaped member 458*a* and between the guide rollers 456*b* and the rail-shaped member 458*b* is set so as to be spaced from the slit 418 toward the side (i.e., in an upper direction as seen in FIG. 13) opposite the bore 416 side. It is therefore unnecessary to form the extensions greatly protruded downward with respect to the sliding table 414 in order to cause the guide rollers 456*a*, 456*b* to project toward the bore 416. The entire sliding table 414 can be reliably rendered thin and the shape of the sliding table 414 can be simplified.

Figure 18:
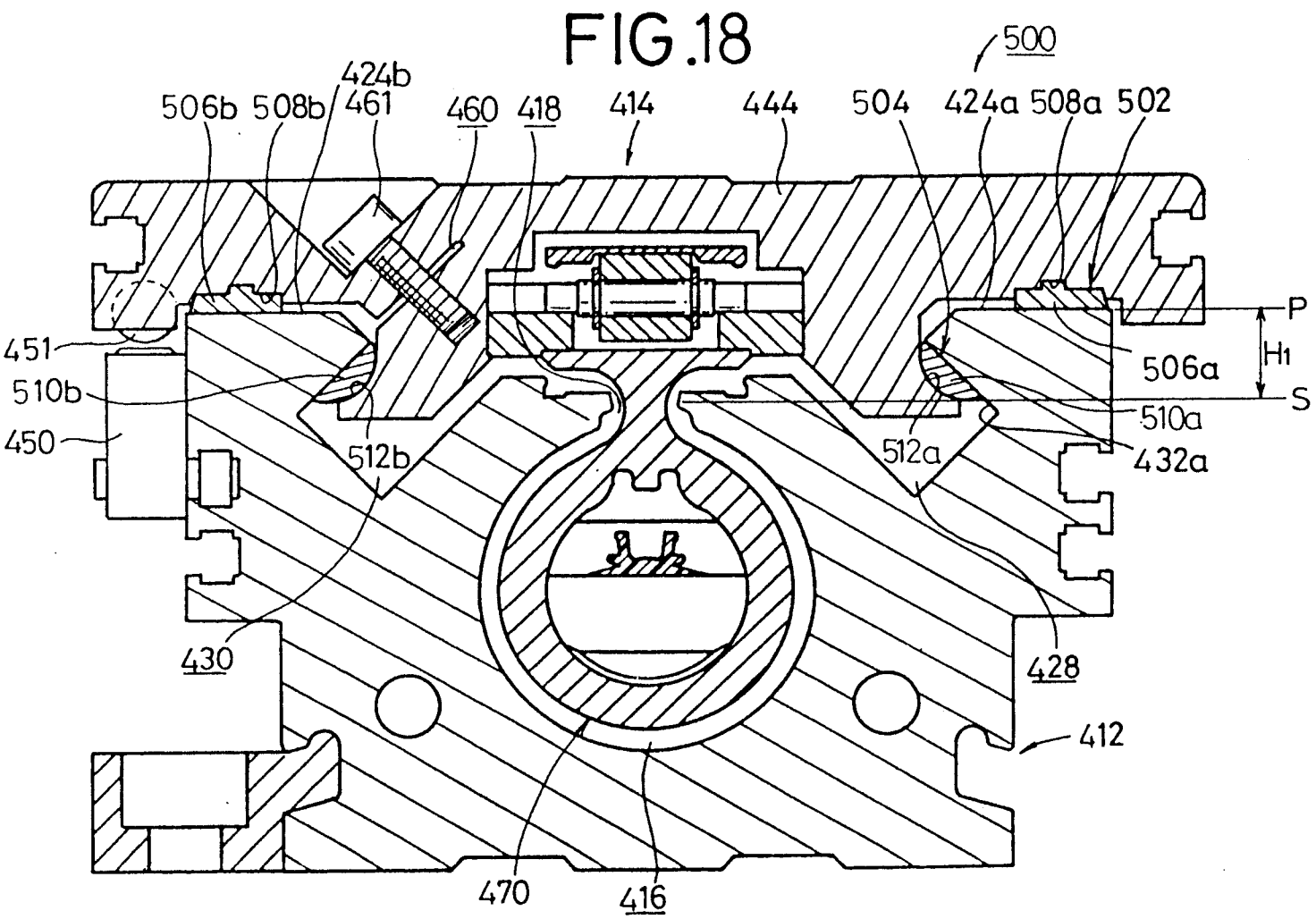
FIG. 18 is a vertical cross-sectional view depicting a rodless cylinder according to a sixth embodiment of the present invention.

A rodless cylinder 500 according to a sixth embodiment of the present invention will next be described below with reference to FIG. 18. Incidentally, reference numerals identical to those employed in the rodless cylinder 400 according to the fifth embodiment indicate the same elements of structure as those employed in the rodless cylinder 400, and their detailed description will therefore be omitted.

The rodless cylinder 500 is provided with a pair of first holding mechanisms 502 and a pair of second holding mechanisms 504. The pair of first holding mechanisms 502 respectively includes stepwise synthetic resin members (wear resistant portions) 506*a*, 506*b* fixed onto their corresponding upper surfaces 424*a*, 424*b* of a cylinder tube 412, and sliding surfaces 508*a*, 508*b* brought into sliding contact with the respective corresponding synthetic resin members 506*a*, 506*b*. The position of each of surfaces (sliding portions) P at which the sliding surfaces 508*a*, 508*b* slide on their corresponding synthetic resin members 506*a*, 506*b*, is set so as to be spaced a distance H1 from the position S of the slit 418 toward the side opposite the bore 16 side.

The pair of second holding mechanisms 504 respectively includes synthetic resin members (wear resistant portions) 510*a*, 510*b* having arcuate cross-sections, which are fixedly mounted on their corresponding side surfaces 432*a*, 432*b* of the cylinder tube 412, and arcuate sliding surfaces 512*a*, 512*b* brought into sliding contact with the respective corresponding synthetic resin members 510*a*, 510*b*. The synthetic resin members 506*a*, 506*b*, 510*a*, 510*b* are formed of materials having excellent sliding characteristics and superb wear resistance respectively.

Accordingly, the pairs of first and second holding mechanisms 502, 504 of the rodless cylinder 500 serve as sliding bearings respectively. The sliding surfaces 508*a*, 508*b* and 512*a*, 512*b* of the sliding table 414 can slide on their corresponding synthetic resin members 506*a*, 506*b* and their corresponding synthetic resin members 510*a*, 510*b* so as to smoothly move the sliding table 414. Incidentally, as an alternative to the synthetic resin members 506*a*, 506*b*, 510*a*, 510*b*, desired portions of either the sliding table 414 or the cylinder tube 412 may be coated with wear resistant surface-treated layers such as synthetic resin films or hard alumite films.

Figure 19:
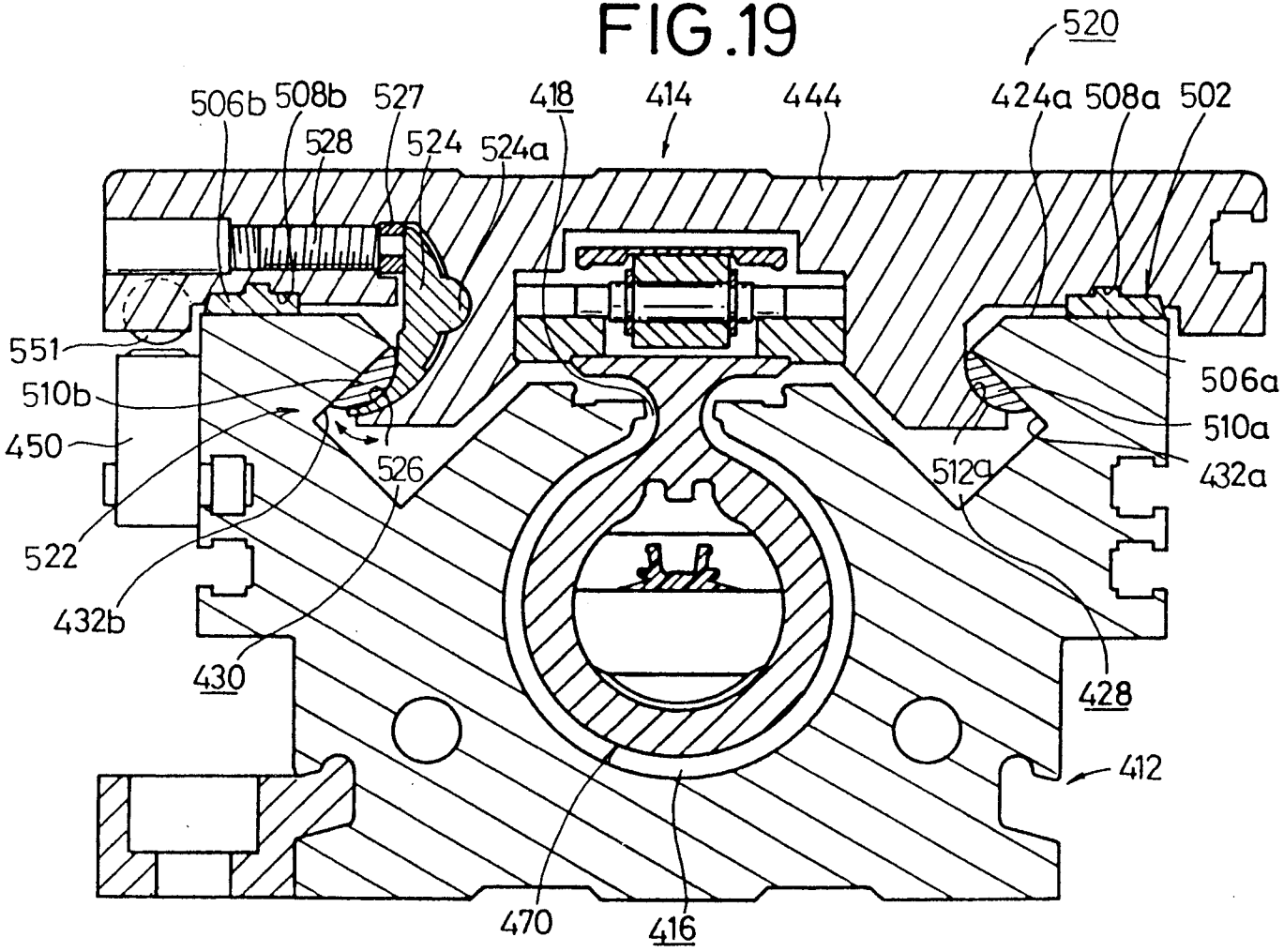
FIG. 19 is a vertical cross-sectional view showing a rodless cylinder according to a seventh embodiment of the present invention.

Further, a rodless cylinder 520 according to a seventh embodiment of the present invention will be described with reference to FIG. 19. Incidentally, reference numerals identical to those employed in the rodless cylinder 500 according to the sixth embodiment indicate the same elements of structure as those employed in the rodless cylinder 500, and their detailed description will therefore be omitted.

The rodless cylinder 520 has a pair of second holding mechanisms 522 in addition to a pair of first holding mechanisms 502. The pair of second holding mechanisms 522 respectively includes a synthetic resin member 510*a* fixed to a side surface 432*a* of a cylinder tube 412 and a sliding surface 512*a* brought into sliding contact with the synthetic resin member 510*a*; and a synthetic resin member 510*b* fixed to a side surface 432*b* and a swinging member 524 brought into sliding contact with the synthetic resin member 510.

The swinging member 524 is swingably mounted to the sliding table 414 about a spherical portion 524*a*. An arcuate sliding surface 526 brought into sliding contact with the synthetic resin member 510*b* is provided at one end of the swinging member 524. A receiving member 527 is held against the other end of the swinging member 524. The receiving member 527 is brought into engagement with a pressing screw thread 528 threadedly inserted into the sliding table 414 along the horizontal direction.

Accordingly, the present rodless cylinder 520 can bring about the same advantageous effects as those obtained by the rodless cylinder 500 according to the sixth embodiment. In particular, the swinging member 524 of one of the pair of second holding mechanisms 522 can be swung about the spherical portion 524*a* under the pressing action of the pressing screw thread 528 and the position of the sliding surface 526 can be freely adjusted with respect to the synthetic resin member 510*b*.

Figure 20:
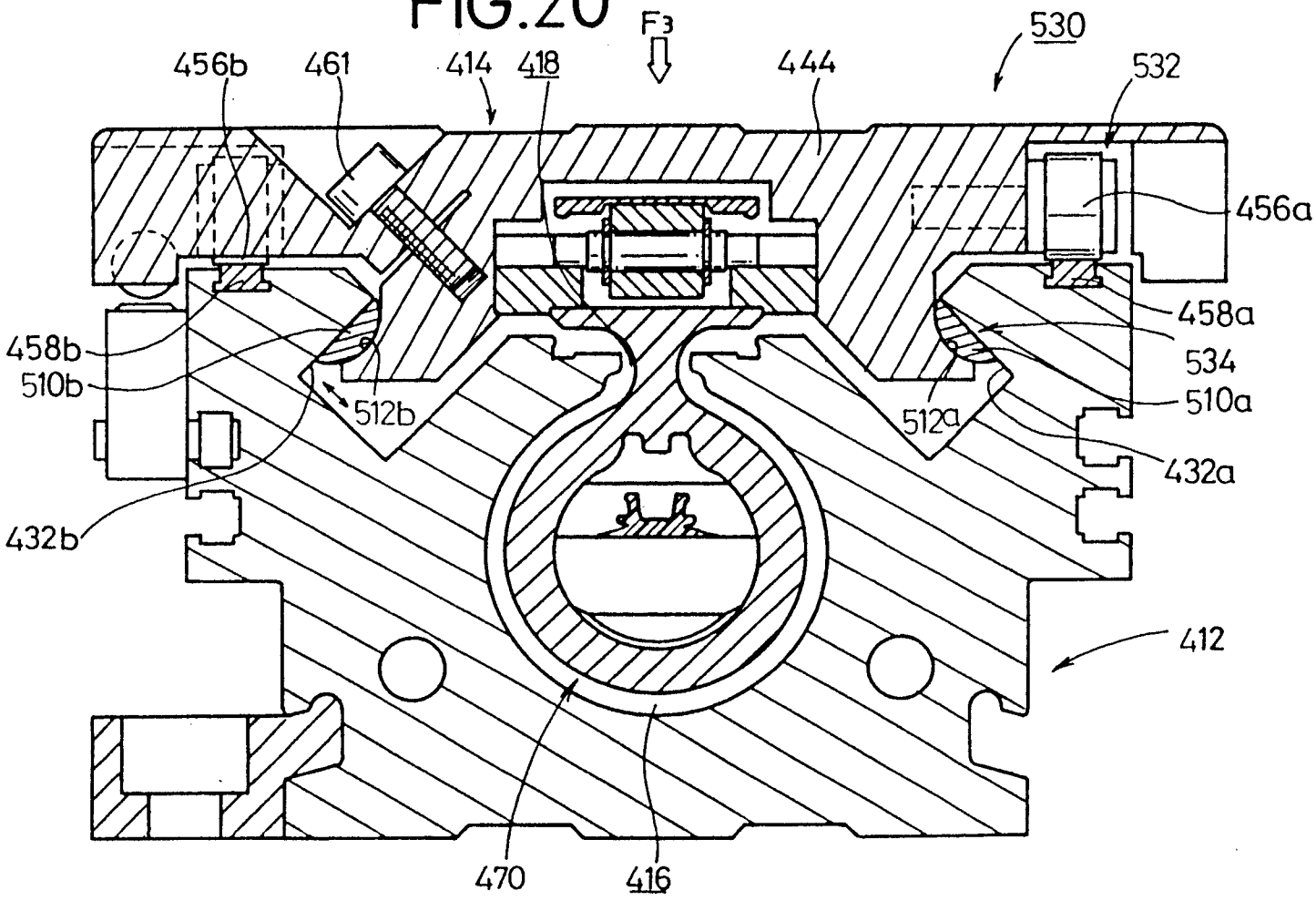
FIG. 20 is a vertical cross-sectional view illustrating a rodless cylinder according to an eighth embodiment of the present invention.

Furthermore, a rodless cylinder 530 according to an eighth embodiment of the present invention will be described below with reference to FIG. 20. Incidentally, reference numerals identical to those employed in the rodless cylinder 400 according to the fifth embodiment and the rodless cylinder 500 according to the sixth embodiment indicate the same elements of structure as those employed in the rodless cylinders 400, 500, and their detailed description will therefore be omitted.

The rodless cylinder 530 includes a pair of first holding mechanisms 532 and a pair of second holding mechanisms 534. In particular, the pair of first holding mechanisms 532 serves to support a vertical load F3 which acts on a sliding table 414 through a workpiece (not shown). Further, the pair of first holding mechanisms 532 respectively includes guide rollers 456*a*, 456*b* and rail-shaped members 458*a*, 458*b*. The pair of second holding mechanisms 534 serves to guide the sliding table 414. Further, the pair of second holding mechanisms 534 respectively serves as sliding bearings which respectively comprise synthetic resin members 510*a*, 510*b* having arcuate cross-sections, which are fixed to their corresponding side surfaces 432*a*, 432*b* of a cylinder tube 412, and arcuate sliding surfaces 512*a*, 512*b* brought into sliding contact with the corresponding synthetic resin members 510*a*, 510*b*.

In the rodless cylinder 530 constructed as described above, the guide rollers 456*a*, 456*b* and the rail-shaped members 458*a*, 458*b* (i.e., rolling portions) are selectively provided in opposing relationship to portions for supporting the vertical load F3 applied to the sliding table 414, whereas the synthetic resin members 510*a*, 510*b* and the sliding surfaces 512*a*, 512*b* (i.e., sliding portions) are selectively provided in opposing relationship to portions other than the above portions. Therefore, the relatively cheap sliding bearings serving as the pair of second holding mechanisms 534, which are respectively comprised of the synthetic resin members 510*a*, 510*b* and the sliding surfaces 512*a*, 512*b*, can be selectively used so as to effectively support the load applied to the sliding table 414 and smoothly move the sliding table 414. Further, the rodless cylinder 530 can be easily reduced in cost as a whole.

Figure 21:
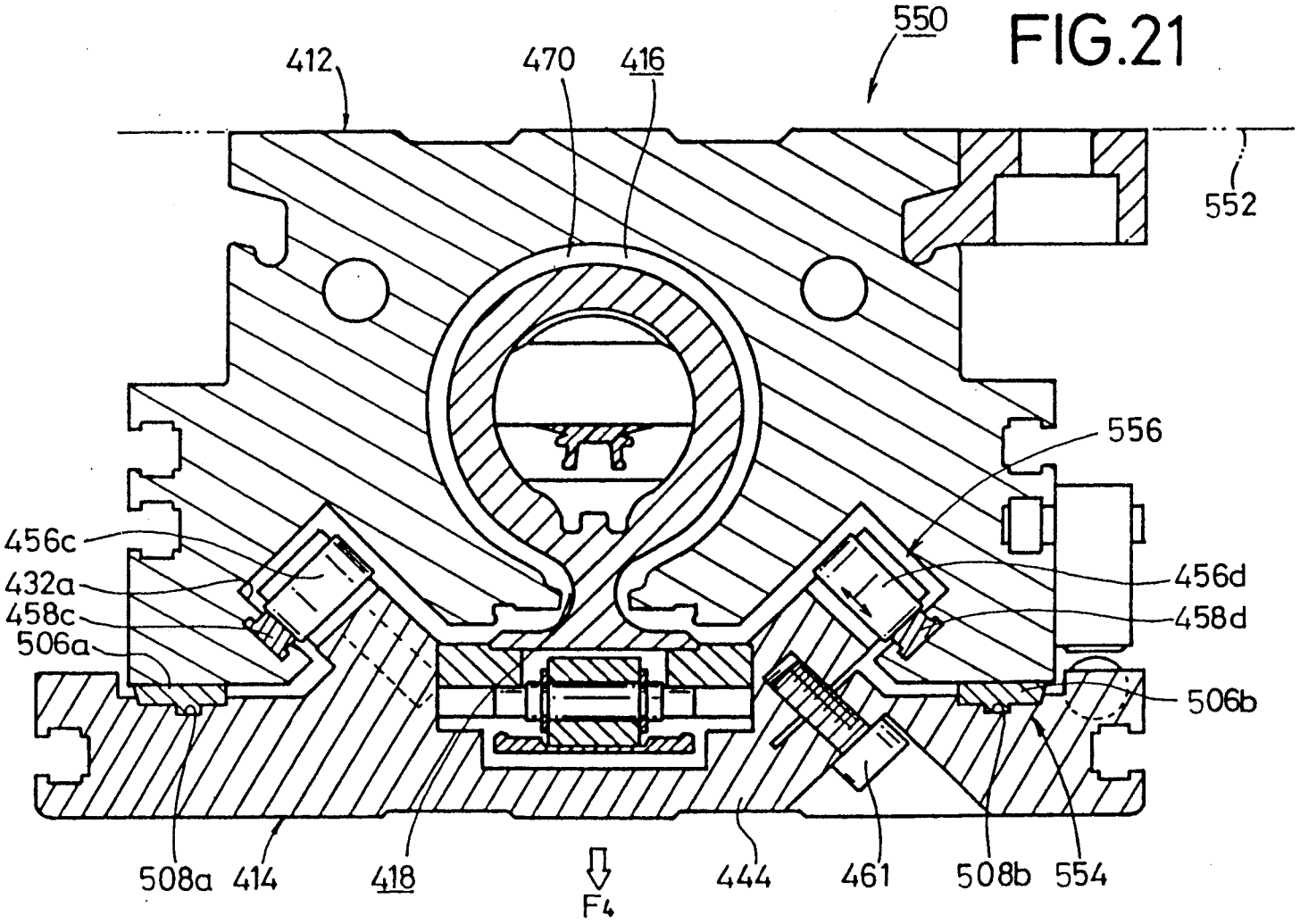
FIG. 21 is a vertical cross-sectional view depicting a rodless cylinder according to a ninth embodiment of the present invention.
Figure 22:
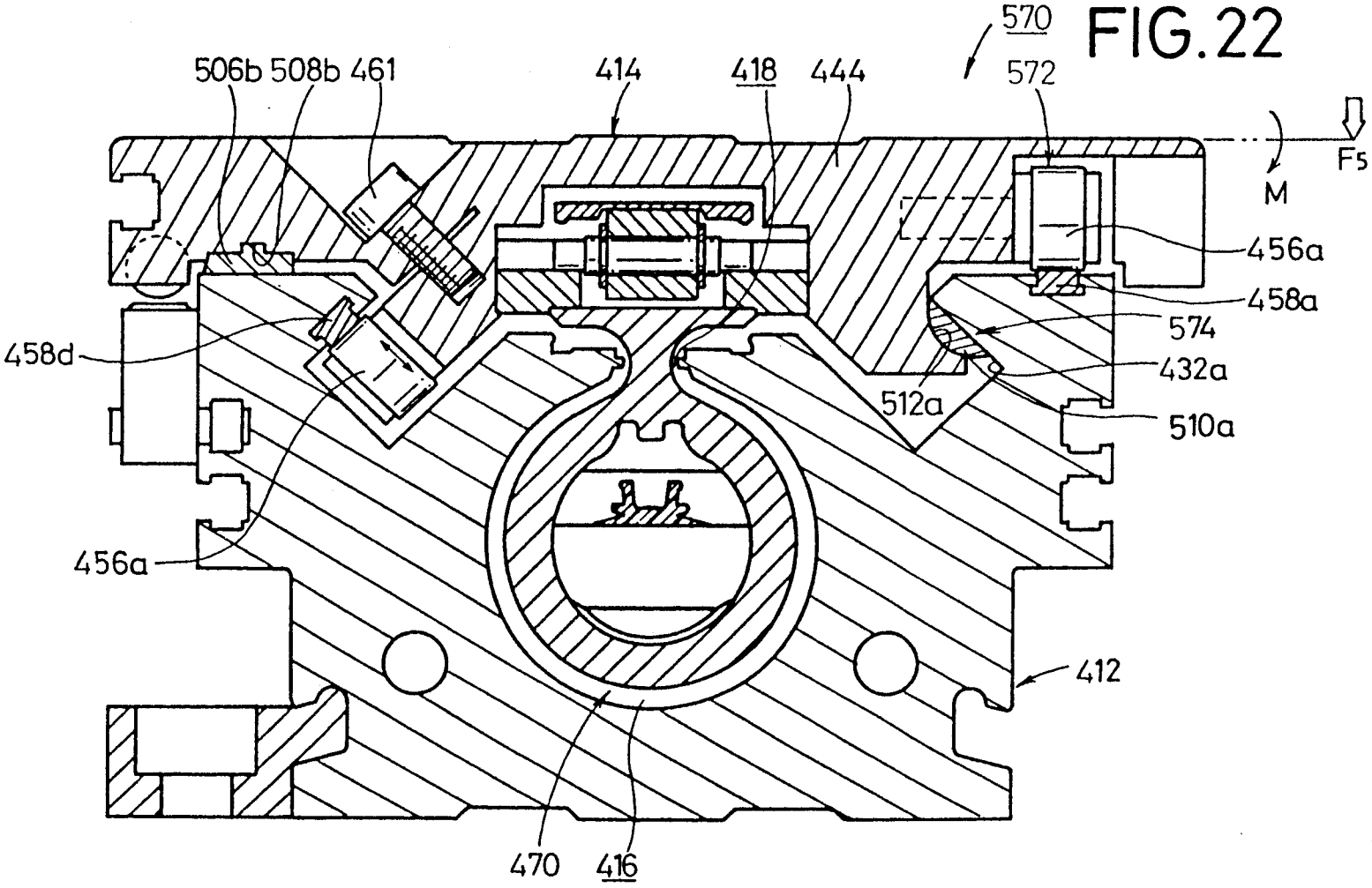
FIG. 22 is a vertical cross-sectional view showing a rodless cylinder according to a tenth embodiment of the present invention.

A rodless cylinder 550 according to a ninth embodiment of the present invention will next be described below with reference to FIG. 21. Incidentally, reference numerals identical to those employed in the rodless cylinder 400 according to the fifth embodiment and the rodless cylinder 500 according to the sixth embodiment indicate the same elements of structure as those employed in the rodless cylinders 400, 500, and their detailed description will therefore be omitted.

The rodless cylinder 550 has a cylinder tube 412 suspended by a horizontally-extending member 552, and a sliding table 414 on which a workpiece (not shown) is mounted and to which a vertical load F4 is applied downwardly. A pair of first holding mechanisms 554 and a pair of second holding mechanisms 556 are mounted to the cylinder tube 412 and the sliding table 414. The pair of first holding mechanisms 554 respectively includes stepwise synthetic resin members 506*a*, 506*b* and sliding surfaces 508*a*, 508*b* brought into sliding contact with the corresponding synthetic resin members 506*a*, 506*b*. The pair of second holding mechanisms 556 includes guide rollers 456*c*, 456*d* for supporting the vertical load F4 exerted on the sliding table 414 and rail-shaped members 458*c*, 458*d*, respectively.

Thus, the rodless cylinder 550 is provided so as to be positionally opposed to the provision of the rodless cylinder 530 according to the eighth embodiment. Therefore, the rodless cylinder 550 can bring about the same effects as those obtained by the rodless cylinder 530 by using the sliding bearings which serve as the pair of first holding mechanisms 554.

Further, a description will be made of a rodless cylinder 570 according to a tenth embodiment of the present invention. Incidentally, reference numerals identical to those employed in the rodless cylinder 400 according to the fifth embodiment and the rodless cylinder 500 according to the sixth embodiment indicate the same elements of structure as those employed in the rodless cylinders 400, 500, and their detailed description will therefore be omitted.

In the rodless cylinder 570, a workpiece (not shown) whose load center is overhung, is placed on the upper surface of the sliding table 414. Therefore, the moment M acts on the sliding table 414 by a vertical load F5 of the workpiece. To this end, the rodless cylinder 570 is provided with first and second holding mechanisms 572, 574 in order to support or receive the moment M.

Each of the first holding mechanisms 572 has a guide roller 456*a* and a rail-shaped member 458*a* located in confronting relationship with a portion for supporting or bearing the moment M. A relatively inexpensive sliding bearing (sliding portion) which comprises a synthetic resin member 506*b* and a sliding surface 508*b*, is provided on the side opposite the rolling portion side. On the other hand, one of the second holding mechanisms 574 includes guide rollers 456*d* and rail-shaped members 458*d* provided in confronting relationship with the portion for supporting the moment M. As the other second holding mechanism 574, a relatively inexpensive sliding bearing (sliding portion) which comprises a synthetic resin member 510*a* and a sliding surface 512*a*, is provided on the side opposite the rolling portion side.

Thus, in the rodless cylinders 530, 550, 570, the rolling portions are disposed in confronting relationship with the portions for supporting the loads which act on the sliding table 414. Further, the sliding bearings, which are of relatively inexpensive sliding portions, are disposed in confronting relationship with the portions other than the above portions. Thus, the sliding table 414 can be smoothly moved without being affected by various loads. Further, the manufacturing cost of the rodless cylinder can be effectively reduced.

Incidentally, each of the rodless cylinders 530, 550, 570 has been described as an illustrative example. If rolling portions are provided in confronting relationship with portions for supporting or bearing a load acting on the sliding table 414 and sliding portions are disposed in opposing relationship to other portions even when the sliding table 414 is vertically moved or even when a workpiece is mounted in different states, for example, then the same advantageous effects as those obtained by the rodless cylinders 530, 550, 570 can be brought about.

According to the present invention, as has been described above, it is possible to reliably avoid a reduction in the inside diameter of a bore even if an overweight load is applied to a sliding table. Further, the sliding table and a piston can be smoothly moved without stopping. It is also possible to reliably avoid any reduction in the inside diameter of the bore and to prevent the piston from being stopped in the course of feeding of a workpiece to a desired location even if an unexpected lateral force is particularly applied.

According to the present invention as well, the positions of sliding portions and/or rolling portions of a pair of first holding mechanisms are set so as to be spaced away from a slit toward the opposite side of a bore. Therefore, a sliding table can be easily reduced in thickness and its shape can be simplified.

Having now fully described the invention, it will be apparent to those skilled in the art that many changes and modifications can be made without departing from the spirit or scope of the invention as set forth herein.

What is claimed is:

1. A rodless cylinder comprising:

a cylinder body having a bore defined in a cylinder tube having ends which are closed and a slit which extends along the longitudinal direction thereof and enables said bore to communicate with the outside;

a piston reciprocatively movable within said bore;

a sliding table coupled to said piston by a connecting portion extending through said slit and moved in accordance with the reciprocating motion of said piston;

first and second sealing members brought into engagement with said piston and said sliding table so as to close said slit;

a first and second pair of holding mechanisms located on both sides of said bore and mounted to said cylinder body and said sliding table; and means for adjusting the position of at least one of said first and second pair of holding mechanisms;

said pair of first holding mechanisms respectively having first support members and first movable members for guiding said sliding table when said piston is reciprocated and for supporting a vertical load which acts on said sliding table;

said pair of second holding mechanisms respectively having second support members and second movable members for guiding said sliding table when said piston is reciprocated and for supporting a load transversely acting on said sliding table so as to prevent the inside diameter of said bore from varying.

2. A rodless cylinder according to claim 1, wherein said holding mechanisms of each of said first and second pair of holding mechanisms are spaced apart.

3. A rodless cylinder according to claim 1, wherein said holding mechanisms of each of said first and second pair of holding mechanisms are inclined in opposite directions to one another.

4. A rodless cylinder according to claim 1, wherein said first pair of holding mechanisms have guide rollers and wherein an axial line of each of said guide rollers of said first pair of holding mechanisms are inclined with respect to a horizontal direction such that said piston is displaceable against moments which act on said slide table without widening said slit.

5. A rodless cylinder according to claim 1, wherein said at least one of said first and second pair of holding mechanisms comprises said second pair of holding mechanisms.

6. A rodless cylinder according to claim 1, wherein at least one of said pair of first support members and said pair of second support members comprise rail-shaped members which extend along the longitudinal direction of said cylinder body and at least one of said first movable members and said second movable members comprise rotatable bodies which roll along said rail-shaped members.

7. A rodless cylinder according to claim 6, wherein at least one pair of rail-shaped members of said pair of second holding mechanism is provided on both sides of said bore defined in said cylinder body, and at least one pair of said rotatable bodies of said pair of second holding mechanisms is provided so as to be held in engagement with said pair of rail-shaped members toward the outside of said bore when a load acts on said sliding table.

8. A rodless cylinder according to claim 6, wherein said means for adjusting the position of at least one of said first and second bodies comprises means for adjusting the position of said second holding mechanism.

9. A rodless cylinder according to claim 8, wherein said means for adjusting the position of at least one of said first and second holding mechanisms comprises:

a rod for eccentrically supporting each of said rotatable bodies, said rod being rotatably about an axis thereof for adjustment;

a screw thread formed onto said rod; and a nut maintained in meshing engagement with said screw thread so as to adjust the position of each of said rotatable bodies along the direction of its axis.

10. A rodless cylinder according to claim 1, wherein at least one of said first movable members and said second movable members comprise guide members which extend along the longitudinal direction of said cylinder body and wherein at least one of said first support members and said second support members comprise synthetic resin members along which at least said guide members slide.

11. A rodless cylinder according to claim 1, wherein at least one of said first movable members and said second movable members comprise guide members which extend along the longitudinal direction of said cylinder body and wherein at least one of said first support members and said second support members comprise wear resistant surface-treated layers formed on portions where at least said guide members slide.

12. A rodless cylinder according to claim 8, wherein said means for adjusting the position of at least one of said first and second bodies intersects the direction of an axis of each of said rotatable bodies.

13. A rodless cylinder according to claim 12, wherein said means for adjusting the positions of at least one of said first and second bodies comprises:

a protrusion for supporting each of said rotatable bodies, said protrusion having a slit cut inwardly of said sliding table; and a bolt threadedly inserted into said protrusion for adjusting the width of said slit, thereby adjusting the position of each of said rotatable bodies along the direction intersecting the direction of the axis thereof.

14. A rodless cylinder according to claim 1, wherein ends of said sliding table, which extend in the direction which intersects the direction of movement of said sliding table, are provided so as protrude outward from ends of said cylinder body and to surround the ends of said cylinder body.

15. A rodless cylinder according to claim 14, wherein at least one position sensor is mounted to a side surface of said cylinder body and a driving member for activating said position sensor is attached to one end of said sliding table in opposing relationship to said position sensor.

16. A rodless cylinder according to claim 1, wherein at least one of said first holding mechanisms and said second holding mechanisms include sliding surfaces which extend along the longitudinal direction of said cylinder body and wear resistant portions with which said sliding surfaces are brought into sliding contact.

17. A rodless cylinder according to claim 16, wherein at least said sliding surfaces and said wear resistant portions of said second holding mechanisms are respectively provided on both sides of said bore defined in said cylinder body, and are disposed so as to be held in engagement with one another toward the outside portion of said bore when a load is exerted on said sliding table.

18. A rodless cylinder according to claim 16, which comprises means for adjusting the positions of at least one of said wear resistant portions brought into sliding contact with said sliding surfaces and said sliding surfaces.

19. A rodless cylinder according to claim 18, wherein said position adjusting means comprises:

a protrusion provided with one of said sliding surfaces and said wear resistant portions and formed with a slit cut inwardly of said sliding table; and a bolt threadedly inserted into said protrusion for adjusting the width of said slit, thereby adjusting the position of said at least one of said sliding surfaces and said wear resistant portions.

20. A rodless cylinder according to claim 18, wherein said position adjusting means includes:

a swinging member formed at one end thereof with said at least one of said sliding surfaces and said wear resistant portions; and a pressing screw thread engageable with the other end of said swinging member so as to swing said swinging member, thereby adjusting the position of said one of said sliding surface and said wear resistant portion.

21. A rodless cylinder according to claim 20, wherein said swinging member is mounted to said sliding table and includes a sliding surface provided at one end thereof.

22. A rodless cylinder according to claim 1, wherein said first holding mechanisms and said second holding mechanisms are respectively selectively provided with rolling portions disposed in opposing relationship to portions for supporting a load which acts on said sliding table.

* * * * *